US009623428B2

(12) United States Patent
Santagiuliana

(10) Patent No.: US 9,623,428 B2
(45) Date of Patent: Apr. 18, 2017

(54) DEVICE FOR DISPENSING FLUIDS

(71) Applicant: TAPLAST S.P.A., Dueville-Povolaro (IT)

(72) Inventor: Evans Santagiuliana, Vicenza (IT)

(73) Assignee: Taplast S.p.A., Dueville-Povolaro (VI) (IT)

( * ) Notice: Subject to any disclaimer, the term of this patent is extended or adjusted under 35 U.S.C. 154(b) by 0 days.

(21) Appl. No.: 14/889,458

(22) PCT Filed: Apr. 29, 2014

(86) PCT No.: PCT/IB2014/061086
§ 371 (c)(1),
(2) Date: Nov. 6, 2015

(87) PCT Pub. No.: WO2014/181218
PCT Pub. Date: Nov. 13, 2014

(65) Prior Publication Data

US 2016/0074889 A1 Mar. 17, 2016

(30) Foreign Application Priority Data

May 8, 2013 (IT) ..... VI2013A0130

(51) Int. Cl.
*B65D 88/54* (2006.01)
*G01F 11/00* (2006.01)
*B05B 11/00* (2006.01)

(52) U.S. Cl.
CPC ..... *B05B 11/3047* (2013.01); *B05B 11/0016* (2013.01); *B05B 11/3004* (2013.01);
(Continued)

(58) Field of Classification Search
CPC ..... B05B 11/3047; B05B 11/0016; B05B 11/3004; B05B 11/3052; B05B 11/3066;
(Continued)

(56) References Cited

U.S. PATENT DOCUMENTS 6,196,424 B1 * 3/2001 Bougamont ..... B05B 11/3026 222/321.9
6,705,493 B1 * 3/2004 Mijers ..... B05B 11/0048 222/321.7

(Continued)

*Primary Examiner* — J. Casimer Jacyna
*Assistant Examiner* — Benjamin R Shaw
(74) *Attorney, Agent, or Firm* — Stolmar & Partner; Robert Lelkes

(57) ABSTRACT

The invention is a fluid dispensing device suited to be connected, by means of a connection element (220), to a container (C) holding the fluid that can be dispensed from the inside to the outside of the container through an actuator element (400), comprising: a suction duct (240) suited to communicate with the fluid held inside the container (C), a dispenser duct (440) in communication with the outer space with respect to the volume (V) enclosed by the container (C), a suction/compression chamber (300) that can communicate with the suction duct (240) and the dispenser duct (440), a suction valve (260) suited to alternatively allow and prevent the passage of a fluid between the suction duct (240) and the suction/compression chamber (300) when, respectively, the suction valve is closed and open, a dispensing valve (460) suited to alternatively allow and prevent the passage of a fluid between the dispenser duct (440) and the suction/compression chamber (300) when, respectively, the suction valve is closed and open, a tight membrane (500) slidingly coupled with the walls of the suction/compression chamber (300) so that it can be translated in a predetermined direction; both the suction valve (260) and the dispensing valve (460) comprise the membrane (500). The invention concerns also a system for containing and dispensing fluids (F).

15 Claims, 19 Drawing Sheets

(52) U.S. Cl.
CPC ..... *B05B 11/3052* (2013.01); *B05B 11/3066* (2013.01); *B05B 11/3074* (2013.01); *B05B 11/306* (2013.01)

(58) Field of Classification Search
CPC ..... B05B 11/3074; B05B 11/306; B05B 11/3046; A47K 5/1209
USPC ..... 222/321.7, 207, 383.1, 319, 320, 321.1
See application file for complete search history.

(56) References Cited

U.S. PATENT DOCUMENTS

| | | | | |
|---|---|---|---|---|
| 6,763,978 | B2 * | 7/2004 | Pritchett | B05B 11/3011 222/321.7 |
| 2005/0051579 | A1 * | 3/2005 | Kasting | B05B 11/306 222/321.7 |
| 2005/0115984 | A1 * | 6/2005 | Pritchett | B05B 11/0043 222/95 |
| 2005/0279770 | A1 * | 12/2005 | Moretti | B05B 11/305 222/321.7 |
| 2008/0000933 | A1 * | 1/2008 | Marelli | B05B 11/3001 222/321.7 |

* cited by examiner

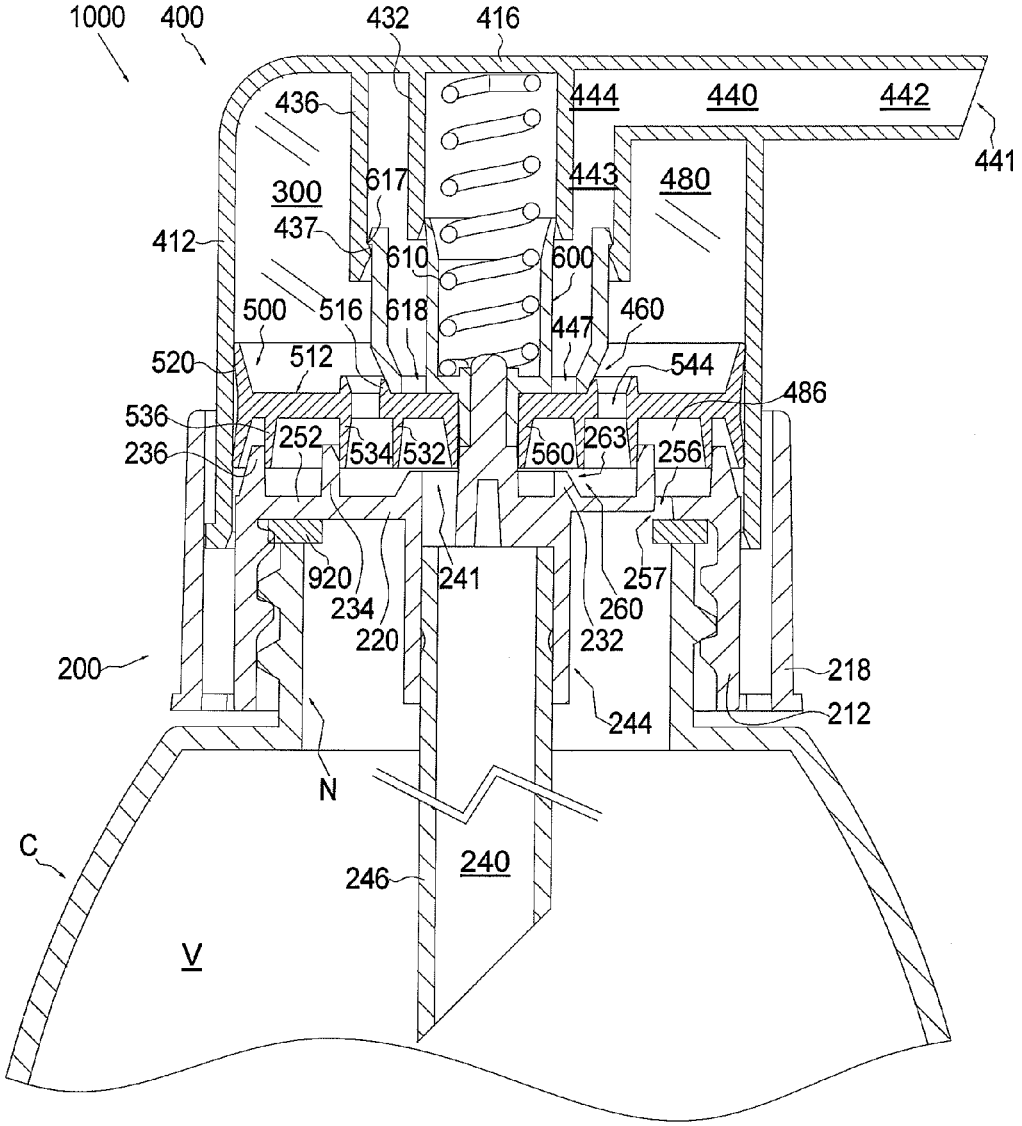
FIG. 2b
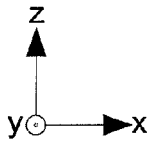

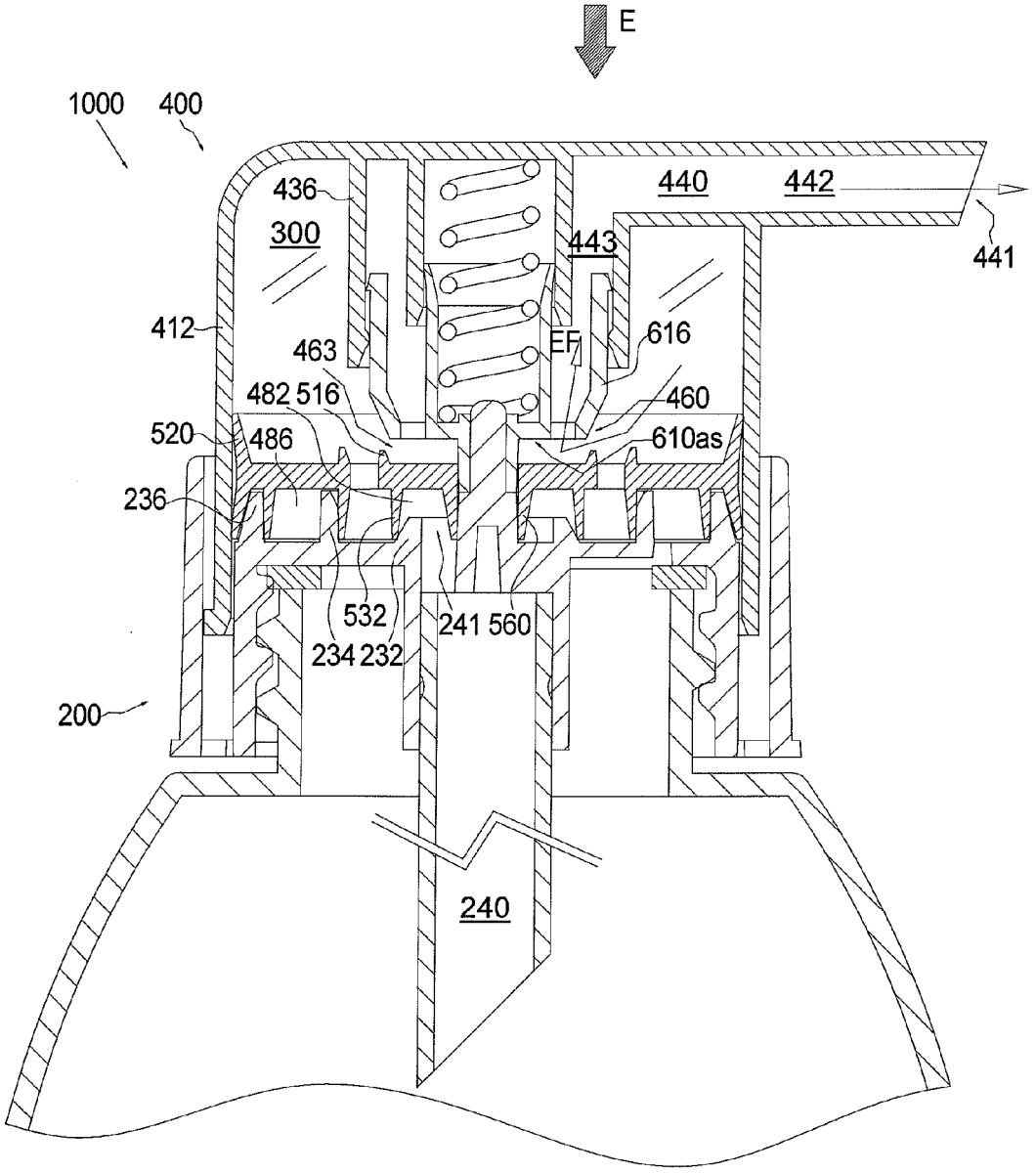
FIG. 2c
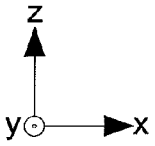

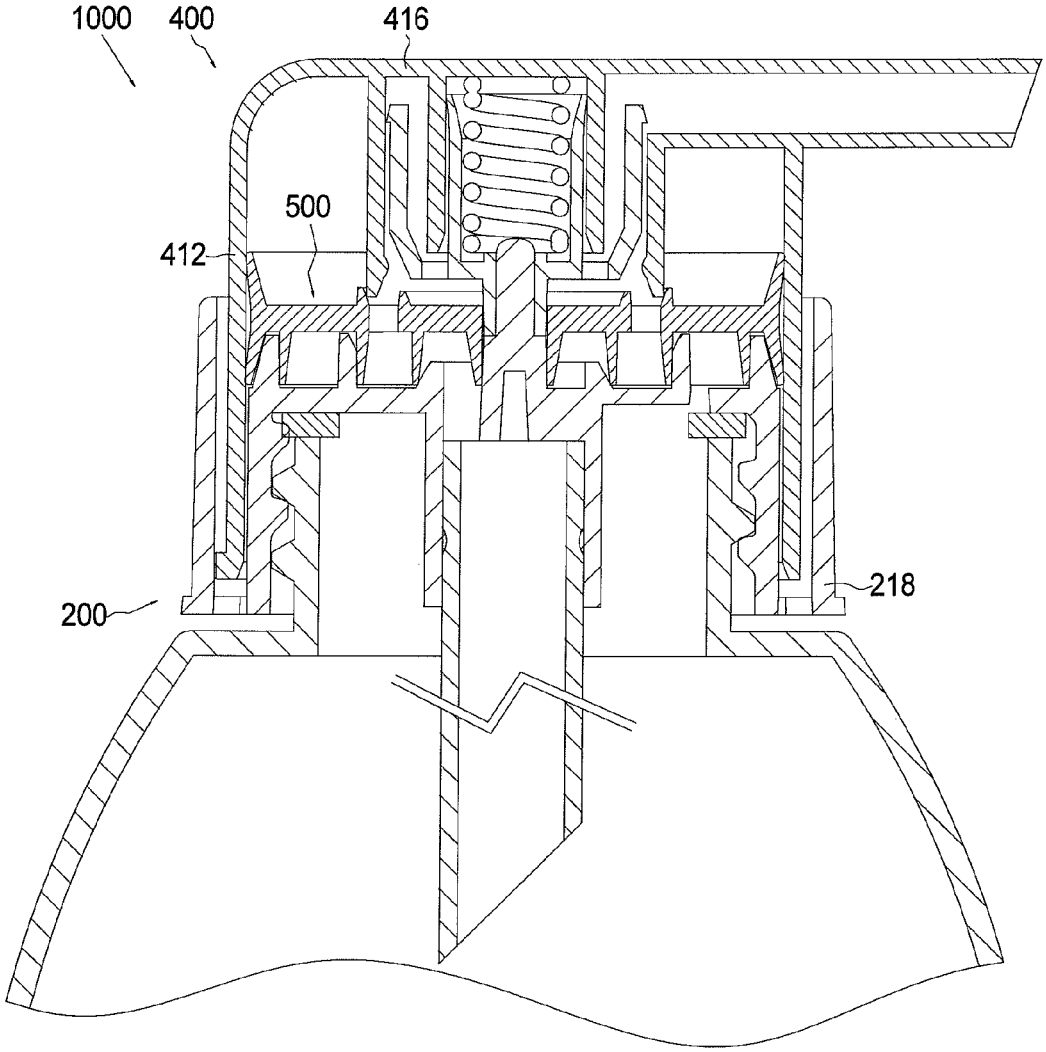
FIG. 2e
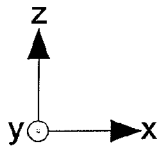

DEVICE FOR DISPENSING FLUIDS

FIELD OF APPLICATION OF THE INVENTION

The invention concerns devices for pumping and dispensing fluids. In greater detail, the present invention concerns a pumping device suited to dispense fluids that are held in a container and suited to be coupled with the neck of the container. The present invention is particularly effective for pumping and dispensing fluid foods, liquid detergents, creams, perfumes and similar substances.

DESCRIPTION OF THE STATE OF THE ART

In the state of the art there are various types of pumps for fluids stored inside a container.

The dispensing pumps of the known type are generally constituted by a suction/compression chamber defined by a hollow body and suited to draw/compress the fluid to be dispensed. The suction/compression chamber communicates with a suction duct that draws the fluid from a container and a dispenser duct that conveys the fluid towards the outside. A first valve is positioned in the pump in such a way as to alternatively close and open the passage between the suction/compression chamber and the suction duct. On the other hand, there is a second valve, separate and distinct from the first valve, intended to close and open the passage that places the suction/compression chamber in communication with the dispenser duct.

The operation of a dispensing pump includes a suction step and a dispensing step. During the suction step, when the liquid is drawn from the container in which it is held and conveyed to the suction/compression chamber, the first valve is open while the second is closed. In this way the fluid is allowed to pass from the container into the suction/compression chamber, and at the same time any fluids present outside the pump cannot be drawn into the suction/compression chamber through the dispenser duct. Vice versa, during the dispensing step the first valve is closed while the second is open, in such a way as to allow the fluid to flow outwards through the dispenser duct, as well as to prevent the fluid from flowing back from the suction/compression chamber into the container.

For example, the German utility model document DE 299 08 586 U1 describes a dispensing pump in which the first valve is constituted by a small ball suited to abut against a projecting annular element of the suction/compression chamber, so as to form a tight area. The second valve, instead, is constituted by a first tight piston suited to slide vertically along the walls of the suction/compression chamber. In its turn, the first piston is slidingly coupled and coaxial with a second piston, the inside of which is provided with a longitudinal cavity. The longitudinal cavity that is provided inside the second piston constitutes a portion of the duct dispensing the liquid from the suction/compression chamber towards the outside. Furthermore, said portion of the dispenser duct communicates with the suction/compression chamber via suitable through holes made in the walls of the second piston. The second valve is constituted by two annular edges of the first piston that are suited to be coupled with corresponding grooves provided on the external surface of the second piston. In the mutual position of the first and second piston, in which the edges are coupled with the corresponding grooves, the valve is closed and the fluid cannot flow through the holes communicating with the dispenser duct.

The European patent EP 1 379 336 B1 discloses an improved version of the dispensing pump just described above. In it, the first piston is structured in such a way as to form three tight areas for the fluid inside the suction/compression chamber.

The dispensing pumps known in the art are thus rather complicated to produce, since there is a large number of component parts to be assembled. In particular, the fact of including two distinct and separate valve elements requires that each one of the two valves be provided with a given number of components that may comprise, as just described, one or more spheres or a membrane.

Furthermore, the dispensing pumps known in the art are particularly subject to malfunction problems that may occur during either the suction or the dispensing step. In particular, the two valves that place the suction/compression chamber in communication with the suction duct and the dispenser duct, respectively, are particularly sensitive components, in fact they can easily be damaged, thus preventing the fluid from being drawn from the container or dispensed towards the outside. The main problems posed by the valves contained in a dispensing pump are due to their movable parts, which are the most sensitive and most subject to damage.

Another limitation of the dispensing pumps known in the art lies in that, when the pump is mounted on the container in which the fluid is held, the hollow body that defines the suction/compression chamber is situated inside the container. More specifically, the suction/compression chamber is located in a portion of the volume enclosed by the container that is under the connection element between the bottle's neck and the pump. Said connection element is also known as the "cap" of the pump.

The position of the suction/compression chamber poses considerable technical limitations to the design of a dispensing pump. First of all, the presence of the chamber inside the container causes a reduction of the useful volume enclosed by the container. In fact, the volume occupied by the suction/compression chamber is taken from the volume that could be occupied by the fluid inside the container. Furthermore, as the suction/compression chamber must be introduced in the container through the neck of the latter, its size is limited by the size of the container's neck. The suction/compression chamber therefore must have such lateral dimensions that allow it to pass through the container's neck when it is introduced in the container. For example, if the suction/compression chamber is defined by cylindrical walls, the diameter of the cylinder defining the chamber must necessarily be smaller than the diameter of the bottle's neck.

In the light of the explanations provided above, it is one object of the present invention to provide a fluid dispensing device that can considerably reduce the drawbacks described with reference to the devices known in the art.

For example, it is one object of the present invention to provide a dispensing device having a simplified structure compared to the devices for analogous uses known in the art. In particular, it is one object of the present invention to provide a dispensing device with a reduced number of component parts compared to the known pumps.

It is a further object of the present invention to provide a fluid dispensing device in which the valve elements are made in a more rational and reliable manner, so as to reduce the occurrence of faults and the risk of malfunction to a minimum.

It is a further object of the present invention to provide a fluid dispensing device which is suited to be applied to a container and whose component parts do not reduce the effective volume of the container where the fluid is held.

It is another object of the present invention to provide a fluid dispensing device whose suction/compression chamber is shorter than the similar pumps available in the art, assuming that it has the same volume.

It is another object of the present invention to provide a fluid dispensing device that is equipped with a suction/compression chamber whose lateral dimensions do not have a maximum limit. In particular, it is one of the objects of the present invention to provide a fluid dispensing device equipped with a suction/compression chamber whose lateral dimensions exceed the diameter of the neck of the container to which the pump is applied.

BRIEF DESCRIPTION OF THE PRESENT INVENTION

The present invention is based on the innovative concept according to which many limitations and many drawbacks of the pumps for fluids known in the art can be eliminated or, at least, considerably reduced by providing a pump for fluids in which a membrane suited to be translated along an axis is suited to perform the function of a valve during both the suction and the dispensing step.

Based on this consideration, the invention proposes a device for dispensing a fluid held inside a container. The fluid dispensing device is suited to be connected, through a connection element, to a container inside which the fluid to be dispensed is held. The fluid can be conveyed from the inside towards the outside of the container through an actuator element (400). The device comprises a suction duct suited to communicate with the fluid held in the container, a dispenser duct in communication with the outside with respect to the volume enclosed by the container and a suction/compression chamber that can communicate with the suction duct and with the dispenser duct. The device comprises also a suction valve suited to alternatively allow and prevent the passage of fluids between the suction duct and the suction/compression chamber when the suction valve is, respectively, closed and open, and a dispensing valve suited to alternatively allow and prevent the passage of fluids between the dispenser duct and the suction/compression chamber when the suction valve is, respectively, closed and open. The device thus comprises a tight membrane that is slidingly coupled with the walls of the suction/compression chamber, in such a way that it can be translated in a direction parallel to the translation direction of the actuator element. Both the suction valve and the dispensing valve comprise the membrane.

According to a further embodiment of the invention, the membrane is suited to be translated in the suction/compression chamber between the suction duct and the dispenser duct.

According to another embodiment of the invention, the membrane is suited to be translated within an interval delimited by a first position and a second position, the suction valve being closed when the membrane is in the first position and the dispensing valve being closed when the membrane is in the second position.

According to a further embodiment of the invention, the membrane is suited to be translated so that when the suction valve is closed the dispensing valve is open and vice versa.

According to another embodiment of the invention, the membrane comprises an upper side facing towards the dispenser duct, the dispensing valve comprising at least one portion of the upper side of the membrane.

According to a further embodiment of the invention, the upper side of the membrane comprises upper sealing means suited to cooperate with the dispenser duct in such a way as to form a tight area, the suction valve being closed when the upper sealing means cooperate with the dispenser duct.

According to another embodiment of the invention, the upper sealing means comprise an annular projection of the upper side of the membrane that is suited to cooperate with the dispenser duct so as to form a tight area that is such as to close a communication opening between the dispenser duct and the suction/compression chamber.

According to a further embodiment of the invention, the membrane comprises a lower side facing towards the suction duct, the suction valve comprising at least one portion of the lower side of the membrane.

According to another embodiment of the invention, the lower side of the membrane comprises lower sealing means suited to cooperate with the dispenser duct in such a way as to form a tight area, the suction valve being closed when the lower sealing means cooperate with the dispenser duct.

According to a further embodiment of the invention, the lower sealing means comprise a projecting annular element suited to cooperate with a projecting annular element formed on the surface of the connection element facing towards the membrane forming a tight area, in such a way as to prevent communication between the suction/compression chamber and the suction duct.

According to another embodiment of the invention, the actuator element comprises a first portion and a second portion that are suited to be rigidly fixed to each other.

According to a further embodiment of the present invention, the suction/compression chamber is defined by the connection element and by the actuator element, in such a way that the suction/compression chamber is at least partially outside the container when the dispensing device is fixed to the container.

According to another embodiment of the invention, the suction/compression chamber is completely outside the container when the dispensing device is fixed to the container.

According to a further embodiment of the present invention, the suction/compression chamber is defined by the connection element and by the actuator element, in such a way that the suction/compression chamber is at least partially inside the container when the dispensing device is fixed to the container.

According to another embodiment of the invention, the dispensing device comprises elastic means suited to exert a force on the actuator element and on the connection element that is such as to maintain the actuator element and the connection element at a maximum predetermined mutual distance.

According to a further embodiment of the invention, a system for containing and dispensing fluids is provided, which comprises a neck and a dispensing device according to any of the embodiments claimed in the attached claims. The dispensing device is fixed to the neck of the container by means of the connection element.

According to another embodiment of the invention, the actuator element is slidingly coupled with the connection element suited to fix the dispensing device to the container. The coupling between the actuator element and the connection element is such that the actuator element is free to be translated along a predetermined direction with respect to the connection element. The fluid can be drawn from the container and conveyed towards the outside following the translation of the actuator element.

According to an embodiment of the invention, the predetermined direction of translation of the membrane is parallel to the direction of translation of the actuator element.

BRIEF DESCRIPTION OF THE DRAWINGS

Further characteristics and advantages of the present invention will be highlighted in the following description of the embodiments of the device according to the present invention that are illustrated in the drawings. In the drawings, identical and/or similar and/or corresponding component parts are identified by the same reference numbers or letters. In particular, in the figures:

FIG. 2*b* shows a longitudinal cross-sectional view of a dispensing device according to the first embodiment of the present invention in the rest position;

FIG. 2*c* shows a longitudinal cross-sectional view of a dispensing device according to the first embodiment of the present invention during the dispensing step;

FIG. 2*e* shows a longitudinal cross-sectional view of a dispensing device according to the first embodiment of the present invention in the locked position;

DETAILED DESCRIPTION OF THE PRESENT INVENTION

The present invention is described here below with reference to some specific embodiments, as shown in the attached drawings. However, the present invention is not limited to the specific embodiments illustrated in the following detailed description and shown in the figures but, rather, the embodiments described herein simply exemplify different aspects of the present invention, the purpose of which is defined in the claims.

Further modifications and variants of the present invention will be clear for the expert in the art. Consequently, the present description must be considered as including all the modifications and/or variants of the present invention, the scope of which is defined in the claims.

The attached drawings represent a set of three Cartesian axes, wherein the oriented z-axis indicates the vertical direction and the plane xy must be understood as a horizontal plane, orthogonal to the vertical direction of the z-axis. Therefore, a direction, axis or plane will be referred to as "vertical" ("horizontal") in the case, respectively, of a direction, axis or plane substantially parallel (orthogonal) to the direction of the z-axis. In particular, a motion or a direction will be referred to as "upward" ("downward") to mean a vertical motion or direction, in the positive (negative) sense of the z-axis.

Here below, and in the entire patent application, expressions of place like "above" or "below" are always to be understood as referred to an oriented axis that indicates the vertical direction. Therefore, given a set of three Cartesian axes, in which the z-axis indicates the vertical direction, the expression "point A above (below) point B" is used to express the concept according to which the segment of the z-axis oriented in the direction from the orthogonal projection of point B on the z-axis to the orthogonal projection of point A on the z-axis is oriented in the positive (negative) sense of the z-axis.

Figure 1:
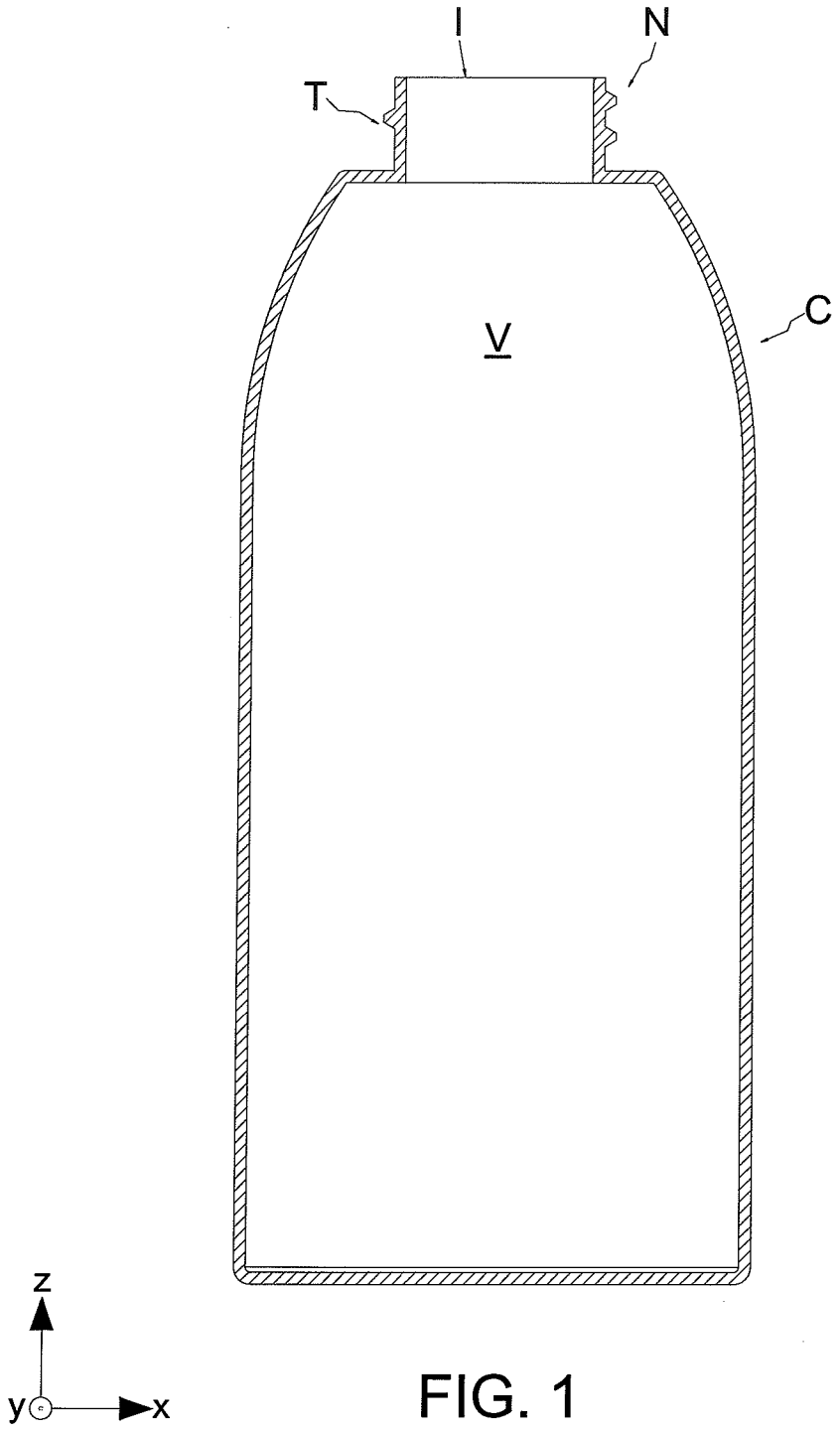
FIG. 1 shows a perspective side view of a container for fluids to which a dispensing device according to the present invention can be applied.

FIG. 1 shows an example of a container C for fluids to which a dispensing device according to the present invention can be applied.

The container C has a longitudinal axis that, in the illustration provided in FIG. 1, is parallel to the z-axis. The container C or a portion of the same can feature cylindrical symmetry with respect to the longitudinal axis of the container C. As previously explained, in the system of Cartesian axes shown in FIG. 1*a*, as well as in the continuation of the description, the plane xy can be imagined as a horizontal plane and the direction z as a vertical direction, orthogonal to the plane xy. The container C delimits an inner cavity with volume V, which defines the maximum capacity of the container C. For example, in the case where the container C contains a liquid, V is the maximum volume of the liquid that can be contained in the container C without overflowing. Here below, a space will be defined as "external" to the container C or "outside" the same to indicate the portion of space not included in the cavity with volume V and not occupied by the container C. Therefore, when reference is made to an object that is "external to" or positioned "outside" the container C, this will mean that each portion of the object in question is situated in the space outside the container C, meaning in the portion of space that is complementary to the space occupied by the volume V and by the container C.

The container C comprises also a neck N provided with an opening I that places the volume V in communication with the external space with respect to the container C. In this way, through the opening I, a fluid can be introduced in the volume V from the outside or drawn from the volume V to be conveyed outside the container. The neck N of the container C can be substantially cylindrical in shape, with longitudinal axis coinciding with the longitudinal axis of the container C. The surface of the neck N facing towards the outside of the container C can be provided with coupling means T, suited to allow a dispensing device according to the present invention to be fixed to the container C. In particular, as described more extensively below, the dispensing device is provided with appropriate coupling means suited to cooperate with the coupling means T in such a way as to allow the dispensing device to be applied to the container C.

Some embodiments of the dispensing device or pump 1000 according to the present invention are described here below.

Figures from 2*a* to 2*f* schematically illustrate a first embodiment of the dispensing device 1000 according to the present invention.

Figure 2A:
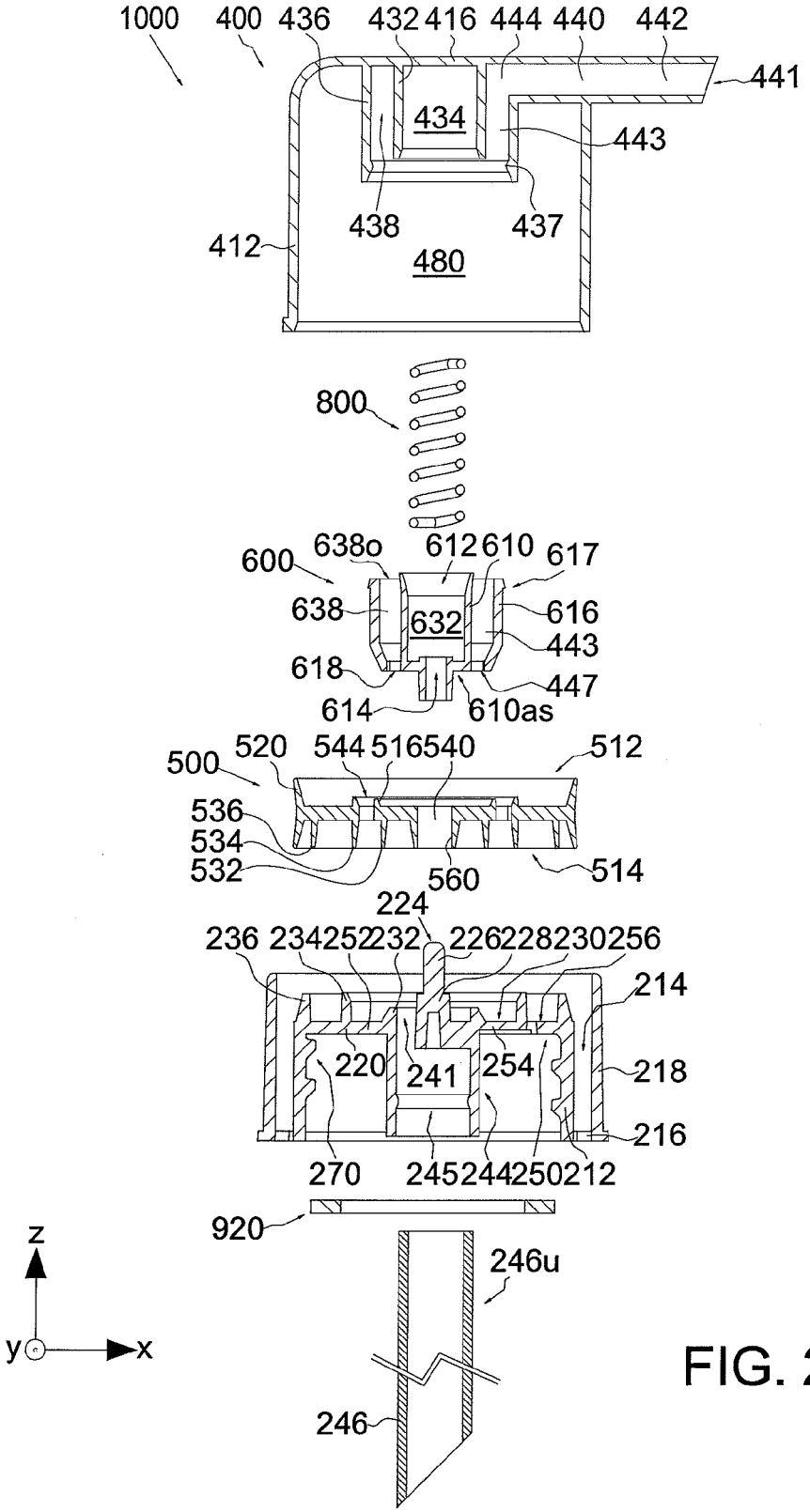
FIG. 2*a* shows a longitudinal exploded cross-sectional view of a dispensing device according to a first embodiment of the present invention.

FIG. 2*a* shows an exploded view of the pump 1000 according to the first embodiment of the invention, in which the component parts can be individually recognized. FIG. 2*b*, instead, shows the pump 1000 fixed to a container C in a rest position, ready for the dispensing step.

The dispensing device 1000 comprises an actuator element 400, a union element 600, a membrane 500 and a connection element 200 that are described in detail below. Furthermore, the dispensing device 1000 comprises a dispenser duct 460 and a suction duct 260. The dispensing device 1000 may also comprise an elastic element 800 and a gasket 920.

As shown in FIG. 2*b*, the actuator element 400, the connection element 200 and the membrane 500 define a cavity in which the fluid suction/compression chamber 300 is obtained. The suction/compression chamber 300 can alternatively be placed in communication with the suction duct 240 and insulated from the suction duct 240 by means of a suction valve 260. Furthermore, the suction/compression chamber 300 can alternatively be placed in communication with the dispenser duct 440 and insulated from the dispenser duct 440 by means of a dispensing valve 460.

With particular reference to FIGS. 2*a* and 2*b*, the pump 1000 comprises an actuator element 400 limited at the top by a top wall 416 and laterally by an annular wall 412. Both the top wall 416 and the annular wall 412 of the actuator element 400 comprise an outer side facing towards the outside of the pump 1000 and an inner side opposite the outer side and facing towards the inside of the pump 1000. The annular wall 412 preferably develops along a substantially vertical direction. The top wall 416 and the annular wall 412 define a cavity 480 inside the actuator element 400. As illustrated below, the suction/compression chamber 300 of the dispensing device 1000 is obtained inside the cavity 480.

The actuator element 400 comprises also a first annular wall 432 that preferably develops along a vertical direction starting from the top wall 416 and defines a housing 434. An elastic element 800 can be arranged in the housing 434, as described below. The actuator element 400 comprises also a second annular wall 436 that develops, too, along a vertical direction and is fixed to the top wall 416. The second annular wall 436 is coaxial with the first annular wall 432 and its diameter is larger than that of the latter. The first annular wall 432 and the second annular wall 436 then define an annular cavity 438.

A dispenser duct 440 is partially formed inside the actuator element 400. The dispenser duct 440 communicates with the outside through its outlet opening 441. The dispenser duct 440 comprises also an inlet opening 447 that, as explained below, is obtained in the union element 600. The dispenser duct 440 can communicate with a suction/compression chamber 300 located inside the pump 1000 through the inlet opening 447. The dispenser duct 440 allows the fluid to be conveyed from the suction/compression chamber 300 towards the outside.

The dispenser duct 440 comprises a first portion 442 that develops along a first direction and communicates with the outside through the outlet opening 441. In the embodiment shown in Figures from 2*a* to 2*f* the first portion 442 of the dispenser duct 440 develops along a substantially horizontal direction.

The dispenser duct 440 comprises also a second portion 444 that develops along a second direction and comprises the inlet opening 447. In the embodiment shown in Figures from 2*a* to 2*f* the second portion 443 of the dispenser duct 440 develops along a substantially vertical direction. As shown in FIG. 2*b* and as described in greater detail below, the second portion 443 of the dispenser duct 440 is included partially in the actuator element and partially in a union element 600.

The first portion 442 and the second portion 443 of the dispenser duct 440 are connected by an intermediate portion 444, in which the dispenser duct 440 follows a curvilinear outline.

The pump 1000 comprises also a connection element 200, suited to allow the dispensing device or pump 1000 to be applied to the container C holding the fluid. A gasket 920, shown in FIG. 2*a*, can be positioned between the container C and the pump 1000 in such a way as to improve tightness when the pump 1000 is applied or fixed to the container C. In other embodiments of the invention not illustrated in the figures, the gasket 920 can be omitted and the connection element 200 can be in direct contact with the neck N of the bottle C.

The connection element 200 is limited laterally by an annular wall 210. The annular wall 210 comprises an inner sub-wall 212 and an outer sub-wall 218, both substantially cylindrical and coaxial with each other. In Figures from 2*a* to 2*f* the common longitudinal axis of the sub-walls 212 and 218 is vertical. The diameter of the inner sub-wall 212 is smaller than the diameter of the outer sub-wall 218, so that the outer sub-wall 218 and the inner sub-wall 212 define an annular cavity 214. The inner sub-wall 212 and the outer sub-wall 218 are connected by means of an annular connection portion 216 of the annular wall 210. The annular connection portion lies on a plane that is substantially orthogonal to the common axis of the inner and outer sub-walls 212 and 218. Preferably, the outer sub-wall 218 is as long as or slightly longer than the inner sub-wall 212.

The connection element 200 comprises connection means 270 suited to cooperate with suitable coupling means T formed on the surface of the container C so as to allow the application of the pump 1000 to the container C. According to the first embodiment of the present invention, the connection means 270 are formed on the surface of the inner sub-wall 212 opposite the surface facing towards the annular cavity 214. This surface of the sub-wall 212 is suited to be directed towards the neck N of the container C, when the dispensing device 1000 is mounted on the container C as shown, for example, in FIG. 2*b*.

The connection means 270, for example, may comprise a thread suited to be coupled with a thread formed on the neck N of the container C. Alternatively, the connection means 270 may comprise means suited to connect the connection element 200 to the neck N of the container by means of a fixing mechanism. For example, the connection means 270 may comprise projections or recesses of the surface of the sub-wall 212 facing towards the neck N of the container, suited to be coupled with projections or recesses formed on the surface of the neck N of the container C facing towards the sub-wall 212. In general, the connection means 270 of the connection element 200 and the coupling means T on the neck N of the container C may comprise any means suited to fix two components among those known to the expert in the art and suitable for the intended purpose. The connection element 200 thus comprises a separator element 220. When the pump 1000 is mounted on the container C, as shown in FIG. 2*b*, the separator element 220 is located at the level of the opening I through which the container C communicates with the outside.

The separator element 220 develops radially and on a horizontal plane from an annular opening 241 coaxial with the sub-walls 212 and 218, until reaching the inner sub-wall 212. As explained below, the opening 241 constitutes the outlet opening of the suction duct 240. The separator element 220 comprises an upper side 230, facing towards the suction/compression chamber 300, and a lower side 250 opposite the upper side 230.

The lower side 250 of the separator element 220 is suited to be directed towards the container to which the dispensing device 1000 is applied. In particular, when the pump 1000 is mounted on the container C, the lower side 250 is directed towards the neck N of the container C and towards the opening I that allows communication between the volume V and the outside of the container C.

The upper side 230 of the separator element 220 is above and outside the neck N of the container C when the pump 1000 is applied to the container C. The upper side 230 comprises an inner projecting annular element 232, an intermediate projecting annular element 234 and an outer projecting annular element 236 that are all coaxial with one another. The diameter of the intermediate projecting annular element 234 is larger than the diameter of the inner projecting annular element 232 and the diameter of the outer projecting annular element 236 is larger than the diameter of the intermediate projecting annular element 234. The inner projecting annular element 232, the intermediate projecting annular element 234 and outer projecting annular element 236 present on the upper side 250 of the connection element 200 are suited to cooperate with corresponding projecting elements formed on one side of the membrane 500 so as to form three distinct annular tight areas, as described in greater detail below.

The separator element 220 comprises a first portion 252 and a second portion 254, such that the thickness of the first portion 252 on the average exceeds the thickness of the second portion 254. The second portion 254 is separated from the first portion 252 by an opening 256 that develops from the upper side 230 to the lower side 250 of the separator element 220.

The portion of the lower side 250 belonging to the first portion 252 of the separator element 220 is preferably flat. As shown in FIG. 2*b*, a portion of the lower side 250 belonging to the first portion 252 is suited to abut against the container C to which the pump is applied or a gasket 920 interposed between the pump 1000 and the container C.

Also the portion of the lower side 250 belonging to the second portion 254 is substantially flat and is positioned along the z-axis at a level that is above the level of the portion of the lower side 250 belonging to the first portion 252. In this way, when the pump 1000 is applied to the container C, an opening 257 is created between the lower side 250 of the separator element 220 and the portion of the container C near which the pump 1000 is applied. The opening 257 is in communication with the opening 256 and with the volume V enclosed by the container C through the neck N of the container C. In this way, thanks to the openings 256 and 257, the volume V enclosed by the container C communicates with the space towards which the upper side 230 of the separator element 220 is directed.

When the pump 1000 is applied to a container C, as shown for example in FIG. 2*b*, the separator element 220 makes it possible to distinguish what portions of the pump 1000 are certainly outside the container C. In fact, with reference to FIG. 2*b*, given a horizontal plane passing through the separator element 220 and the opening 256, two half-spaces are defined: a first half-space below and a second half-space above the given plane. The pump 1000 is constructed in such a way that the container C is entirely contained in the first half-space. Therefore, all the portions of the pump contained in the second half-space are necessarily outside the container C. FIG. 2*b* shows, in particular, that the suction/compression chamber 300 is entirely located in the second half-space and, therefore, above and outside the container C. In other words, a horizontal plane that passes through the separator element 220 of the connection element 200 and through the opening 256 being drawn, the container C and the suction/compression chamber 300 are located in two opposite half-spaces defined by the plane, when the pump 1000 is mounted on the container C.

The connection element 200 comprises also a pin 224, suited to be accommodated in a housing 614 provided in the union element 600, as described in greater detail below. More particularly, the pin 224 comprises a base 228 rigidly fixed to the separator element 220. The pin 224 comprises also a tapered terminal portion 226 that develops from the base 228 in a direction that is substantially parallel to the direction of the side sub-walls 212 and 218. Between the base 228 of the pin 224 and the separator element 220 there is an annular opening 241 that is such as to place the suction duct 240 in communication with the suction/compression chamber 300. The opening 241 thus constitutes the outlet opening of the suction duct 240.

The suction duct 240 allows the fluid to be conveyed from the volume V enclosed by the container C to the suction/compression chamber 300. As shown in FIG. 2*b*, the suction duct 240 comprises an upper portion 244 that is firmly fixed to the connection element 200 and comprises the outlet opening 241. Furthermore, the suction duct 240 comprises a substantially tubular lower portion 246 connected to the upper portion 244. The lower portion 246 comprises an end portion 246*u* suited to be fixed to an end portion 245 of the upper portion 244. Advantageously, the inner diameter of the end portion 245 of the upper portion 244 is almost equal to the outer diameter of the end portion 246*u* of the tubular lower portion 246, so that the upper portion 244 and the lower portion 246 can be connected by simply fitting the end 246*u* of the lower portion 246 into the end 245 of the upper portion 244 of the suction duct 240. The lower portion 246 of the suction duct 240 also comprises a further end portion not shown in the figures and comprising an inlet opening of the suction duct 240. This end portion of the suction duct 240 is suited to be immersed in the fluid held inside the container C. The dispensing device 1000 comprises also a union element 600 that is provided with a housing 614 suited to accommodate the tapered portion 226 of the pin 224. The housing 614 preferably features cylindrical symmetry along a longitudinal axis. In this way the union element 600 remains firmly fixed to the connection element 200. When the union element 600 is fixed to the pin 224, the outer wall of the housing 614 and the wall of the base 228 of the pin 224 form a substantially cylindrical smooth annular surface without steps. As explained below, an inner wall of the membrane 500 is suited to slide along this annular surface.

The union element 600 comprises a substantially cylindrical portion 610 defining a cavity 632 that communicates with the housing 614. The longitudinal axis of the cylindrical portion 610 substantially coincides with the longitudinal axis of the housing 614. The cavity 632, furthermore, communicates with the outside also through an upper opening 612 that is provided at the level of a first end portion of the cylindrical portion 610. The outer surface of the cylindrical portion 610 then forms an annular abutment surface 610*as* in proximity to a second end portion opposite the first end and located in proximity to the housing 614. Said abutment surface is suited to abut against the membrane 500, as described in greater detail below.

The union element 600 comprises also an annular wall 616 whose diameter is larger than the diameter of the cylindrical portion 610 and is coaxial with the cylindrical portion 610. The cylindrical portion 610 and the annular wall 616 thus define an annular cavity 638. The annular cavity 638 communicates with the outside through an annular opening 638*o* positioned near the first end portion of the union element 600. Furthermore, the annular cavity 638 communicates with the outside through one or more communication holes 618 made near the second end portion of the union element 600. If the communication holes 618 are more than one, they are made in such a way that they are all at the same distance from the common longitudinal axis of the cylindrical portion 610 and of the outer annular wall 616. The annular cavity 638 constitutes a second sub-portion of the portion 443 of the dispenser duct 440, as described here below.

The union element 600 is slidingly coupled with the actuator element 400, as shown in FIG. 2*b*. More specifically, the first end portion of the cylindrical portion 610 is slidingly coupled with the surface of the wall 432 facing towards the cavity 434 of the actuator element 400. Furthermore, the external surface of the outer annular wall 616 of the union element 600 is slidingly coupled with the surface of the second annular wall 436 of the actuator element 400 facing towards the annular cavity 434. The actuator element 400 can thus be translated along the vertical direction z with respect to the union element 600 fixed to the connection element 200.

As shown in FIGS. 2*a* and 2*b*, the invention may comprise a safety mechanism comprising an annular projection 437 formed on the internal surface of the second annular wall 436 and suited to be coupled with a corresponding annular projection 617 formed on the external surface of the outer annular wall 616, in such a way as to prevent the actuator element 400 and the union element 600 from being spaced by a mutual distance exceeding a predetermined maximum distance. In particular, the maximum predetermined distance is achieved when the annular projection 437 of the second annular wall 436 cooperates with and abuts against the annular projection 617 of the outer annular wall 616.

As shown in FIG. 2*b*, when the actuator element 400 and the union element 600 are coupled together, the cavity 632 defined by the cylindrical portion 610 of the union element 600 communicates with the cavity 434 defined by the cylindrical wall 432 of the actuator element, thus forming a single cavity in which an elastic element 800 can be introduced, as shown in FIG. 6*b*. The elastic element 800 may comprise, for example, a helical spring, a bellows spring, an elastomeric element or, in general, any means with high elastic properties. The elastic element 800 is suited to exert a force on the actuator element 400 and on the union element 600 rigidly fixed to the connection element 200, so as to maintain the actuator element 400 and the connection element 200 at a predetermined maximum distance from each other. The maximum predetermined distance may for example be the distance that is achieved when the annular projection 437 of the second annular wall 436 cooperates with and abuts against the annular projection 617 of the outer annular wall 616 of the union element 600. The elastic element 800 is not essential for the present invention and in other embodiments not shown in the figures it can be omitted.

Furthermore, again with reference to FIG. 2*b*, when the union element 600 is connected to the actuator element 400, the annular cavity 638 defined by the cylindrical element 610 and by the outer annular wall 616 of the union element 600 communicates, through the opening 638*o*, with the annular cavity 438 defined by the first annular wall 432 and by the second annular wall 436 of the actuator element 400 forming a single annular cavity. This annular cavity formed in this way constitutes the second portion 443 of the dispenser duct 440. The second portion 443 of the dispenser duct 440 communicates, near a first end, with the intermediate portion 444 of the dispenser duct 440 and, near the second end, opposite the first end, with the cavity 480 defined inside the actuator element through the communication holes 618 of the union element 600. Therefore, the communication holes 618 coincide with the inlet opening 447 of the dispenser duct 440.

In addition to being slidingly coupled with the union element 600, the actuator element 400 is slidingly coupled with the connection element 200. In this way, the actuator element can be translated with respect to the connection element 200 and to the union element 600 fixed to it. The direction of translation of the actuator element 400 is parallel to the direction of the vertical axis z. The coupling is obtained by means of the outer annular wall 412 of the actuator element 400 that is accommodated in the annular cavity 214 defined by the inner sub-wall 212 and by the outer sub-wall 218 of the side wall 210 of the connection element 200. In this way, the diameter of the annular wall 412 of the actuator element is included between the diameter of the inner sub-wall 212 and the diameter of the outer sub-wall 218 of the side wall 210 of the connection element 200.

When the actuator element 400 is coupled with the union element 600 and the connection element 200 as shown in FIG. 2*b*, the cavity 480 inside the actuator element 400 is limited at the bottom by the separator element 220 of the connection element 200. The suction/compression chamber 300 of the dispensing device 1000 is thus obtained inside the cavity 480 defined by the actuator element 400. More specifically, the suction/compression chamber 300 is obtained in the portion of the cavity 480 limited at the top by the top wall 416 of the actuator element 400, laterally by the outer annular wall 412 of the actuator element 400 and at the bottom by the upper side 230 of the separator element 220 of the connection element 200. The entire suction/compression chamber 300 is thus completely outside the container C when the pump 1000 is mounted on the container C.

The suction/compression chamber can be placed in communication with the suction duct 240 through its outlet opening 241 and with the dispenser duct 440 through its inlet opening 447. It can be noted that the volume of the suction/compression chamber 300 in general varies according to the position of the actuator element 400 with respect to the connection element 200. Analogously, also the length of the second portion 443 of the dispenser duct 440 varies as the mutual distance between the connection element 200 and the actuator element 400 varies. More particularly, the volume of the suction/compression chamber 300 and the length of the second portion 443 of the dispenser duct 440 increase (decrease) as the distance of the actuator element 400 from the connection element 200 increases (decreases).

The pump 1000 comprises also a tight membrane 500. The membrane 500 comprises an upper side 512 facing towards the cylindrical portion 610 of the union element 600, and a lower side 514 opposite the upper side 512 and facing towards the connection element 200.

The membrane 500 of the pump 1000 comprises a first annular wall 520 and a second annular wall 560 that is coaxial with the first annular wall 520 and whose diameter is smaller than the diameter of the first annular wall 520.

The first annular wall 520, or outer wall, is suited to be slidingly coupled with the surface of the annular wall 412 of the actuator element 400 facing towards the cavity 480. The annular wall 520 forms a tight assembly with the inner surface of the annular wall 412.

The second annular wall 560, or inner wall, defines a substantially cylindrical through hole 540. The longitudinal axis of symmetry of the cylindrical hole 540 will be defined as the longitudinal axis of the membrane 500. The membrane 500 can feature cylindrical symmetry with respect to its longitudinal axis that, in the Figures from 2*a* to 2*e*, is parallel to the vertical axis z.

The hole 540 is suited to accommodate the pin 224 in which the union element 600 is fitted, in such a way as to constrain the membrane 500 and translate it according to an axis that is parallel to the direction of development of the pin 224, meaning in the vertical direction z indicated in the figures. The second annular wall 560 is thus coupled with a substantially cylindrical annular surface formed by the base 228 of the pin 224 and by the outer surface of the union element 610 that defines the housing 614. Even the second annular wall 560 of the membrane 500 forms a tight assembly with the surface with which it is coupled.

The membrane 500 comprises one or more communication holes 544 that develop from the upper surface 512 to the lower surface 514 of the membrane 500. If the communication holes 544 are more than one, they are preferably made so that their distance from the longitudinal axis of the membrane 500 is substantially the same.

The lower side 514 of the membrane 500 comprises three projecting annular elements 532, 534 and 536 that are all coaxial with one another. More specifically, on the lower side 514 of the membrane 500 there are an inner projecting annular element 532, an intermediate projecting annular element 534 and an outer projecting annular element 536. The diameter of the intermediate projecting annular element 534 is larger than the diameter of the inner projecting annular element 532. In its turn, the diameter of the outer projecting annular element 536 is larger than the diameter of the intermediate projecting annular element 534. The inner projecting annular element 532, the intermediate projecting annular element 534 and the outer projecting annular element 536 of the membrane 500 are suited to cooperate, respectively, with the inner projecting annular element 232, the intermediate projecting annular element 234 and the outer projecting annular element 236 of the connection element 200 in such a way as to form three corresponding annular tight areas. In particular, the outer projecting annular elements 536 and 236 of the membrane 500 and of the connection element 200 may cooperate in such a way as to form an outer annular tight area. The intermediate projecting annular elements 534 and 234 of the membrane 500 and of the connection element 200 may cooperate in such a way as to form an intermediate annular tight area. Finally, the inner projecting annular elements 532 and 232 of the membrane 500 and of the connection element 200 may cooperate in such a way as to form an inner annular tight area.

As is described in greater detail below, the inner projecting annular elements 532 and 232 are included in the suction valve 260 and are suited to alternatively form and interrupt the inner annular tight area, thus causing the suction valve 260 to be respectively closed and opened. Furthermore, the outer projecting annular element 236 of the connection element 200 is preferably shaped in such a way that it can be coupled with the outer projecting annular element 536 of the membrane 500 and also with a portion of the outer annular wall 520 of the membrane 500 that is not sealingly coupled with the inner surface of the annular wall 412 of the actuator element 400. The outer projecting annular element 236 of the connection element 200 can thus be suited to form the outer annular tight area with just one between the outer projecting annular element 536 of the membrane 500 and the outer annular wall 520 of the membrane 500 or simultaneously with both of them.

FIG. 2*b* shows that between the lower side 514 of the membrane 500 and the upper side 230 of the separator element 220 an outer annular area 486 is created that develops in radial direction from the intermediate annular tight area to the outer annular tight area. This outer annular area 486 is constantly separated and tightly insulated from the suction/compression chamber 300. The outer annular area 486 is also in communication with the volume V enclosed by the container C through the opening 257 between the connection element 200 and the container C and the opening 256 formed through the thickness of the separator element 220.

The upper side 512 of the membrane 500 comprises an upper projecting annular element 516 suited to cooperate with the dispenser duct 440 in such a way as to alternatively open and close the dispensing valve 460, as described in greater detail below.

The membrane 500 can be translated along the vertical direction z with respect to the connection element 200. The translation of the membrane 500 can take place between a top dead centre and a bottom dead centre. The membrane 500 is at the top dead centre when the annular abutment surface 610*os* abuts against the upper side 512 of the membrane 500, as illustrated for example in FIGS. 2*b* and 2*d*.

Vice versa, the membrane 500 is at the bottom dead centre when the membrane 500 is at such a distance from the connection element 200 that the inner projecting elements 232 and 532 cooperate in such a way as to form the inner annular tight area. The membrane 500 at the bottom dead centre is illustrated, for example, in FIG. 4*c*. When the pump 1000 is mounted on the container C, the translation of the membrane 500 takes place completely outside the container C. As previously mentioned, a suction valve 260 and a suction valve 460 are used to adjust fluid communication between the suction chamber and, respectively, the suction duct 240 and the dispenser duct 440. Both the suction valve 260 and the dispensing valve 460 comprise the same membrane 500. The suction valve 260 and the dispensing valve 460 are suited to be alternatively opened and closed through the translation of the membrane 500 as indicated below.

As explained below, the same membrane 500 constitutes the only movable part of both the suction valve 260 and the dispensing valve 460. In this way the dispensing device 1000 according to the present invention assumes an extremely simplified structure and much higher reliability compared to the devices for analogous uses available in the art.

The suction valve 260 comprises the inner projecting annular element 232 of the connection element 200 and the inner projecting annular element 532 of the membrane 500.

When the membrane 500 is at the bottom dead centre, the inner projecting annular elements 232 and 532 of the connection element and of the membrane 500 form the inner annular tight area. With the membrane 500 in this position with respect to the connection element 200, an inner annular area 482 is formed, which is shown, for example, in FIG. 2*c*. The inner annular area 482 develops radially from the inner wall 560 of the membrane 500 to the inner annular tight area formed by the inner projecting annular elements 232 and 532, respectively of the connection element 200 and of the membrane 500. Said inner annular area 482 is separated and tightly insulated from the suction/compression chamber 300 when the inner projecting annular elements 532 and 232 cooperate to form the inner annular tight area. Furthermore, the inner annular area 482 is in communication with the suction duct 240 through its outlet opening 241. Therefore, when the membrane 500 is at the bottom dead centre, the inlet opening 241 of the suction duct 240 is intercepted through the inner annular area 482 and the fluid cannot flow between the suction duct 240 and the suction/compression chamber 300. The suction valve 260 is thus closed.

Figure 2D:
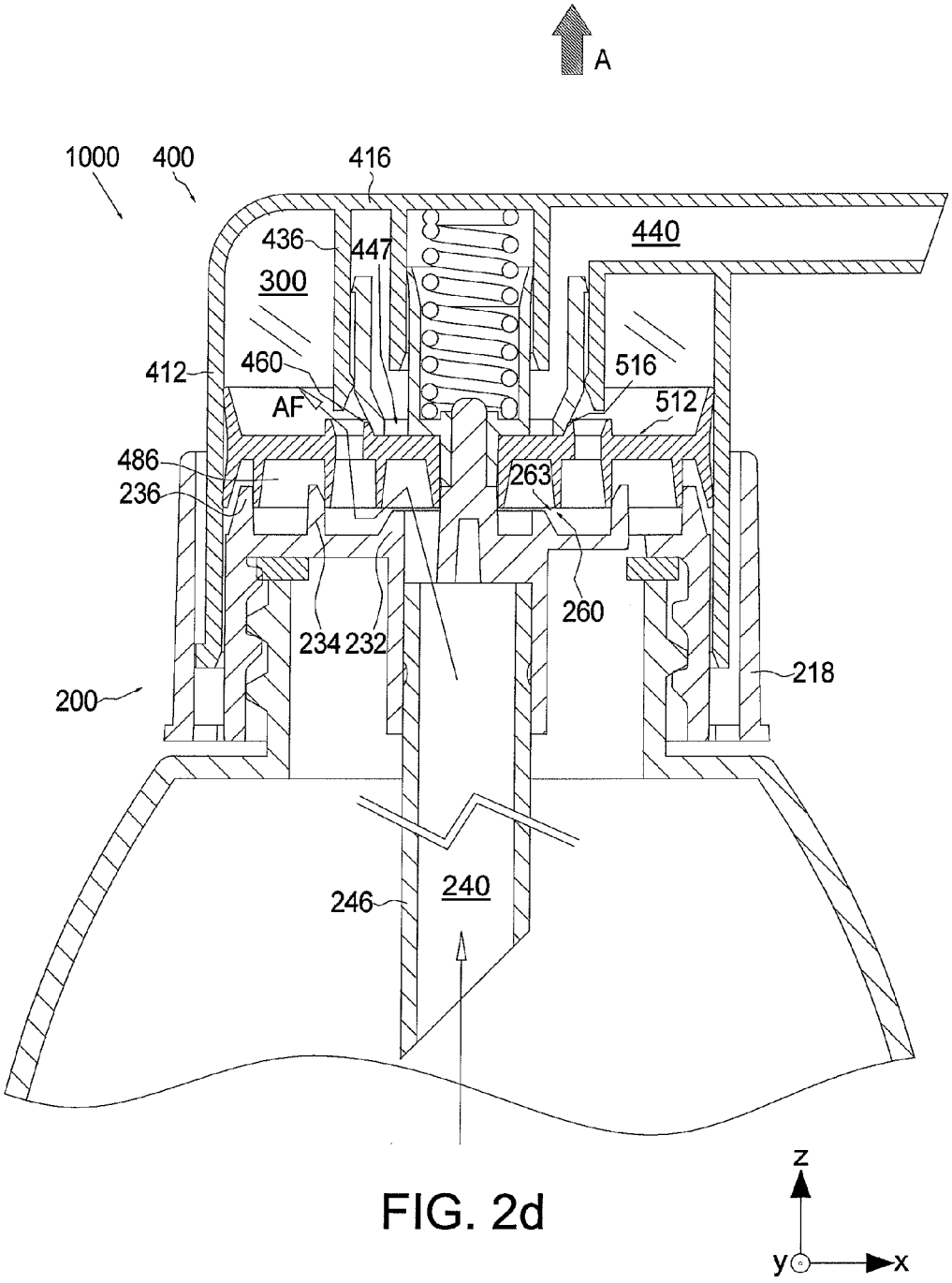
FIG. 2*d* shows a longitudinal cross-sectional view of a dispensing device according to the first embodiment of the present invention during the suction step.

On the other hand, when the membrane 500, starting from the bottom dead centre, translates in the positive direction of the vertical axis z so as to move away from the connection element 200, an opening 263 is formed between the inner annular projecting elements 232 and 532 of the connection element 200 and of the membrane 500, as shown for example in FIGS. 2*b* and 2*d*. The opening 263 interrupts the tight area, thus allowing communication between the suction duct 240 and the suction/compression chamber 300 through the communication hole or the plurality of communication holes 544 of the membrane 500. In this configuration of the membrane 500, the suction valve 260 is open. It can be noted that the annular opening 263 increases as the relative distance between the membrane 500 and the connection element 200 increases. In particular, the opening 263 reaches its maximum amplitude when the membrane 500 is at the top dead centre, as shown in FIG. 2*d*. With the suction valve 260 open, it is no more possible to identify an inner annular area, like the area 482 shown in FIG. 2*c*, tightly insulated from the suction/compression chamber 300.

With reference to FIGS. 2*a* and 2*b*, the dispensing valve 460 comprises a portion of the membrane 500 and a portion of the dispenser duct 440. In greater detail, the dispensing valve 460 comprises an annular portion of the upper side 512 that develops radially from the inner wall 560 towards the upper projecting annular element 516. Furthermore, the dispensing valve 460 comprises an end portion of the dispenser duct 440 located in proximity to the inlet opening 447 with which the upper projecting annular element 516 is suited to cooperate.

When the membrane 500 is at the top dead centre of its translation range shown, for example, in FIG. 2*d*, a portion of the upper side 512 of the membrane 500 intercepts the inlet opening or openings 447 of the dispenser duct 440. The upper annular projecting element formed on the upper side 512 of the membrane 500 is then coupled with an end portion of the dispenser duct 440 located in proximity to the inlet opening 447 in such a way as to form an annular tight area. Once the annular tight area has been formed, the dispenser duct 440 is insulated from the suction/compression chamber 300. The dispensing valve 460 is therefore closed. At the same time, an opening 263 is formed between the inner projecting annular elements 532 and 232, in such a way as to place the suction duct 240 in communication with the suction/compression chamber 300 via the communication through holes 544 present in the membrane 500. With the membrane at the top dead centre, the suction valve 260 is therefore open.

As soon as the membrane 500, starting from the top dead centre, is translated in the negative sense of the z-axis so as to approach the connection element 200, an opening 463 is created between the end portion of the dispenser duct 460 near which there is the inlet opening 471 and the annular portion of the upper side 512 of the membrane 500 belonging to the dispensing valve 460. The opening 463, shown for example in FIG. 2*c*, places the suction/compression chamber 300 in communication with the dispenser duct 440 through its inlet opening 447. The dispensing valve 460 is thus open. The amplitude of the opening 463 increases as the distance between the membrane 500 and the connection element 200 decreases. In particular, the maximum amplitude of the opening 463 is achieved when the membrane is at the bottom dead centre shown in FIG. 2*c*, in which the suction valve 260 is closed.

The explanation provided above shows that the suction valve 260 can be closed only when the dispensing valve 460 is open. The contrary is true as well. Therefore, the dispensing valve 460 can be closed only when the suction valve 260 is open. In particular, when the membrane 500 is at the bottom dead centre shown in FIG. 2*c*, the suction valve 240 is closed and the dispensing valve 460 is open so as to allow the maximum flow of fluid possible between the suction/compression chamber 300 and the dispenser duct 440. Vice versa, when the membrane 500 is at the top dead centre shown in FIG. 2*d*, the dispensing valve 460 is closed and the suction valve 260 is open so as to allow the maximum flow of fluid possible between the suction/compression chamber 300 and the suction duct 240. The operation of the pump 1000 during the dispensing and suction steps is respectively illustrated in FIGS. 2*c* and 2*d*.

During the dispensing step, shown in FIG. 2*c*, a force is applied to the actuator element 400 along the direction and in the sense defined by the arrow E, meaning a force oriented in the negative sense of the vertical axis z. For example, it is possible to apply a pressure to the top wall 416 of the actuator element 400. Therefore, the actuator element 400 is translated as a consequence of the force exerted along the same direction and in the sense indicated by the arrow E. The translation of the actuator element 400 causes a decrease in the volume of the suction/compression chamber 300 which, in its turn, determines an increase in the pressure of the fluid or fluids contained in the suction/compression chamber 300.

The compression of the fluid inside the suction/compression chamber 300 causes a translation of the membrane 500 in the direction and sense defined by the arrow E, so that the membrane 500 moves away from the abutment surface 210*as* of the cylindrical element 610 and from the inlet opening 447 of the dispenser duct 400, approaching the connection element 200. As soon as the top side 512 of the membrane 500 loses contact with the annular abutment surface 610*as*, an annular opening 463 is formed between the top side 512 of the membrane and the portion of the dispenser duct 440 that is near the inlet opening 447, as explained above. The opening 463 allows communication between the suction/compression chamber 300 and the dispenser duct 440 through its inlet opening 447, thus determining the opening of the dispensing valve 460. The translation of the membrane 500 continues until it reaches the bottom dead centre shown in FIG. 2*c*. As previously indicated, in this position the inner projecting annular element 232 of the connection element 200 cooperates with the inner projecting annular element 532 of the membrane 500 in such a way as to form the inner annular tight area. This closes the suction valve 260, preventing communication between the suction/compression chamber 300 and the suction duct 240. The fact that the suction valve 260 is closed prevents the fluid from flowing from the suction/compression chamber 300 back into the suction duct 240 during the dispensing step. The fluid contained in the suction/compression chamber 300 is subjected to the pressure forces and therefore can only flow into the dispenser duct 400 and, from there, be conveyed towards the outside through the outlet opening 441 of the dispenser duct 400. The route of the fluid during the dispensing step is schematically shown by the arrow EF.

It can be noted that during the dispensing step the dispensing valve 460 generally opens before the suction valve 260 has closed. In fact, the suction valve closes only when the membrane 500 has reached the end of stroke during its downward translational motion, arriving at the bottom dead centre. On the other hand, the dispensing valve 460 starts opening as soon as the downward translational motion of the membrane 500 starts. This characteristic is shared by the pumps known in the art. Therefore, it is desirable to minimize the delay time between the opening of the dispensing valve 460 and the closing of the suction valve 260 during the dispensing step. According to the present invention, the delay time can be minimized by making the stroke of the membrane 500 between the top dead centre and the bottom dead centre as short as possible. In addition or alternatively to that, it is possible to increase the diameter of the upper projecting element 516 or of the inner projecting annular element 532 in such a way as to increase the flow rate of the dispensing valve 460 and of the suction valve 260, respectively. This means that it is possible to increase the diameter of the annular tight areas formed by the membrane with the dispenser duct 440 and with the suction duct 240 so that, with the membrane at the same distance from the dispenser duct 440 and from the suction duct 240, the dispensing valve 460 and the suction valve 260 respectively ensure the largest possible flow of fluid. In this way, it is possible to reduce the translation range of the membrane without reducing the flow of fluid through the dispensing valve 460 and the suction valve 260. The suction step generally follows the dispensing step and is schematically shown in FIG. 2*d*. A force is applied to the actuator element along the direction and in the sense defined by the arrow A, meaning in the positive sense of the vertical axis z. This force can be exerted manually. If elastic means 800 are provided, as shown in Figures from 2*a* to 2*e*, the force can be exerted on the actuator element 400 by the elastic means 800 that, typically, were compressed during the previous dispensing step. The actuator element 400 is thus translated in the positive sense of the z-axis due to the action of the force exerted on it.

The translation of the actuator element along the direction and in the sense defined by the arrow A, that is, in the positive sense of the vertical axis z, generates a negative pressure inside the suction/compression chamber 300 that causes the membrane 500 to be translated in the positive sense of the vertical axis z, in accordance with the translation of the actuator element 400. As soon as the membrane 500 starts moving away from the separator element 220 of the connection element 200, the annular tight area between the inner projecting annular element 532 of the membrane 500 and the inner projecting annular element 232 of the connection element 200 is interrupted, leaving an annular opening 263 between the inner projecting annular elements 232 and 532. The suction duct 240 is placed in communication with the suction/compression chamber 300 through the opening 263. The suction valve 260 is thus open. The translation of the membrane 500 with respect to the connection element 200 continues until the membrane reaches the top dead centre. In this configuration, the upper side 512 of the membrane 500 abuts against the abutment surface 610*as* of the union element 600. Furthermore, a portion of the upper side 512 and the upper projecting annular element 516 intercept the inlet openings 447 of the dispenser duct 440, in such a way as to insulate the dispenser duct 440 from the suction/compression chamber 300. Therefore, the dispensing valve 460 closes. The fluid can thus flow from the suction duct 240 into the suction/compression chamber 300 following a route that is schematically indicated by the arrow AF.

It can be observed that, as shown in Figures from 2*b* to 2*e*, the intermediate and outer annular tight areas respectively formed by the intermediate projecting annular elements 234, 534 and by the outer projecting annular elements 236, 536 maintain their respective tightness independently of the position of the membrane 500 with respect to the connection element 200. Therefore, the outer annular area 486 remains insulated from the suction/compression chamber independently of the position of the membrane 500 with respect to the connection element 200 and to the dispenser duct 440 and independently of the open or closed position of the suction valve 260 and of the dispensing valve 460.

FIG. 2*e* shows the pump 1000 in the locked position, in which suitable locking means maintain the actuator element 400 locked in the position in which it is at the minimum distance from the connection element 200.

Figure 2F:
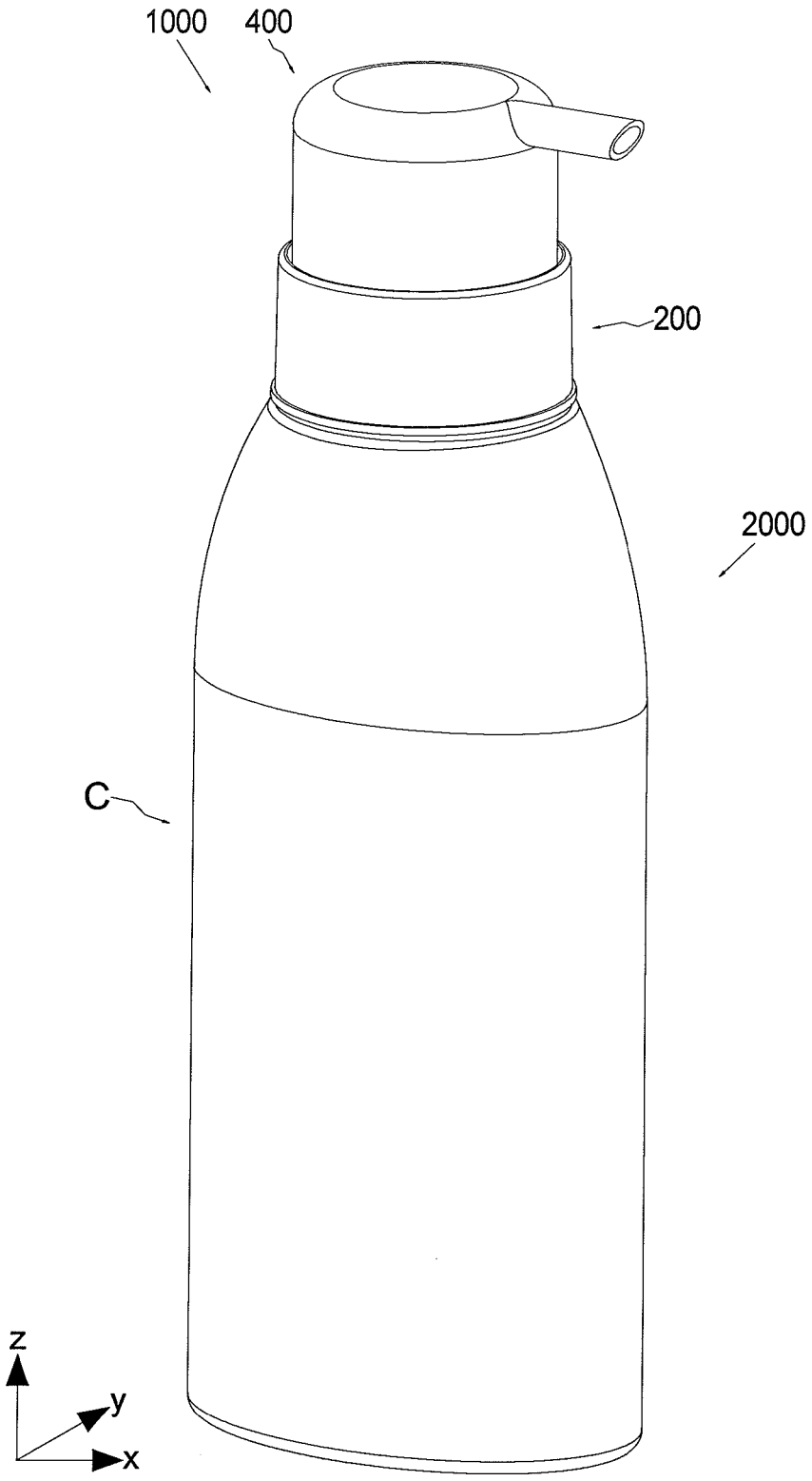
FIG. 2*f* shows a perspective side view of a system for containing and dispensing fluids comprising a container to which a dispensing device according to the first embodiment of the present invention is applied.

FIG. 2*f* shows a system 2000 suited to contain and dispense fluids, comprising the dispensing device 1000 according to the first embodiment of the invention applied to a container C.

The pump 1000 is such that a single membrane 500 can serve the function of a dispensing valve and of a suction valve. This is obtained by allowing the membrane to be translated between a top dead centre, in which the dispensing valve 460 is closed and the suction valve 260 is open, and a bottom dead centre, in which the suction valve 260 is closed and the dispensing valve 460 is open. The number of component parts of the pump 1000 can thus be reduced compared to the fluid dispensing devices known in the art, thus ensuring money and time savings.

The pump 1000 according to the first embodiment of the present invention does not include any valve needing movable spherical elements. Furthermore, both the suction valve and the dispensing valve comprise the membrane as their single movable part. Therefore, the number of movable parts in the dispensing device is reduced. This ensures higher reliability and increased sturdiness of the pump according to the present invention, as the movable parts are the most sensitive and the most subject to damage and malfunctions.

The suction/compression chamber of the dispensing device according to the first embodiment of the invention is situated outside the container holding the fluid to be dispensed. This makes it possible to avoid reducing the useful volume inside the container due to the presence of the suction/compression chamber in the container itself.

It should be noted that it is recommendable to have suction/compression chambers with the largest possible volume, so that large quantities of fluid can be contained therein, as desired. Increased capacity of the suction/compression chamber means that a larger volume of fluid is pumped towards the outside on each individual dispensing cycle. In the devices in which the suction/compression chamber is located inside the container, the increase in the capacity of the suction/compression chamber would reduce the useful volume inside the container. Furthermore, in these devices the suction/compression chamber cannot develop in the lateral direction (width) but only in the longitudinal direction (length). Therefore, when facing the problem of how to increase the volume of the suction/compression chamber, a designer can only increase its length but not its width. In any case, also the length of the suction/compression chamber has a maximum limit since, clearly, it cannot exceed the length of the container. Furthermore, an excessively long suction/compression chamber is not recommendable, as it would lengthen the stroke of the liquid compression piston or pistons inside the container in a not desirable manner, thus making the fluid dispensing step more complex.

Being positioned outside the container, the suction/compression chamber can be designed in such a way that it can assume any desired shape and size. In fact, the container to which the pump has to be applied does not determine any limit to the lateral and longitudinal dimensions of the suction/compression chamber, contrary to that which happens in the devices requiring that the suction/compression chamber be positioned inside the container. In particular, it is possible to design a suction/compression chamber in any desired width and, therefore, even with width exceeding the diameter of the container's neck. The volume of the suction/compression chamber can thus be increased as desired.

Furthermore, as the suction/compression chamber is completely obtained in a cavity of the actuator element 400, it is not necessary to introduce in the pump a further hollow body inside which there is the suction/compression chamber. The pump according to the first embodiment of the invention thus makes it possible to eliminate a further component part compared to the analogous pumps known in the art. In addition to simplifying the design of the device, this makes it possible to considerably reduce production times and costs.

Figures from 3*a* to 3*f* schematically show a second embodiment of the pump 1000 according to the present invention.

The second embodiment of the invention differs from the first embodiment substantially for the actuator element. All the other component parts have the same shape and functions as the corresponding parts of the pump 1000 according to the first embodiment of the invention. It is understood that, if not specified otherwise, the description of similar or identical component parts provided with reference to the first embodiment of the invention can be applied to the second embodiment of the invention.

Figure 3A:
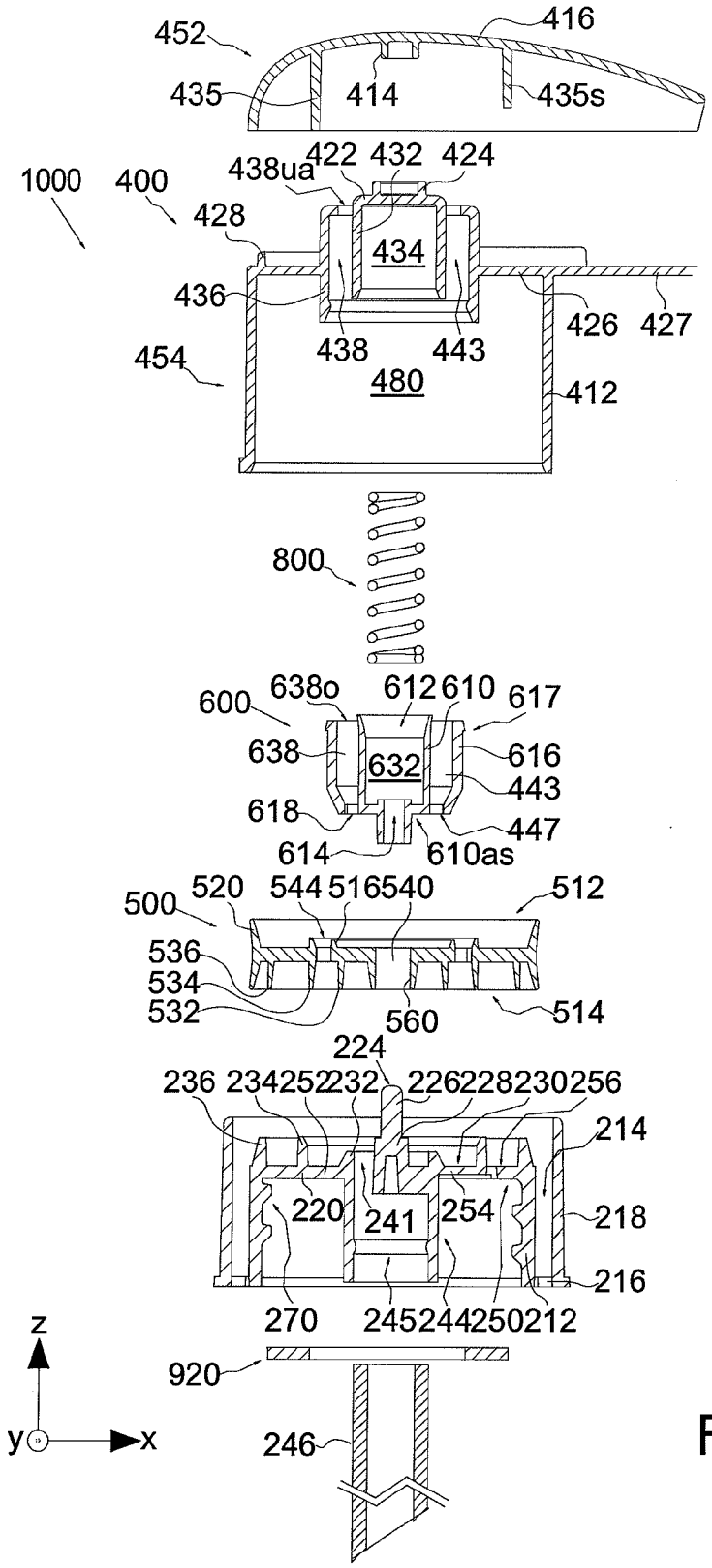
FIG. 3*a* shows a longitudinal exploded cross-sectional view of a dispensing device according to a second embodiment of the present invention.
Figure 3B:
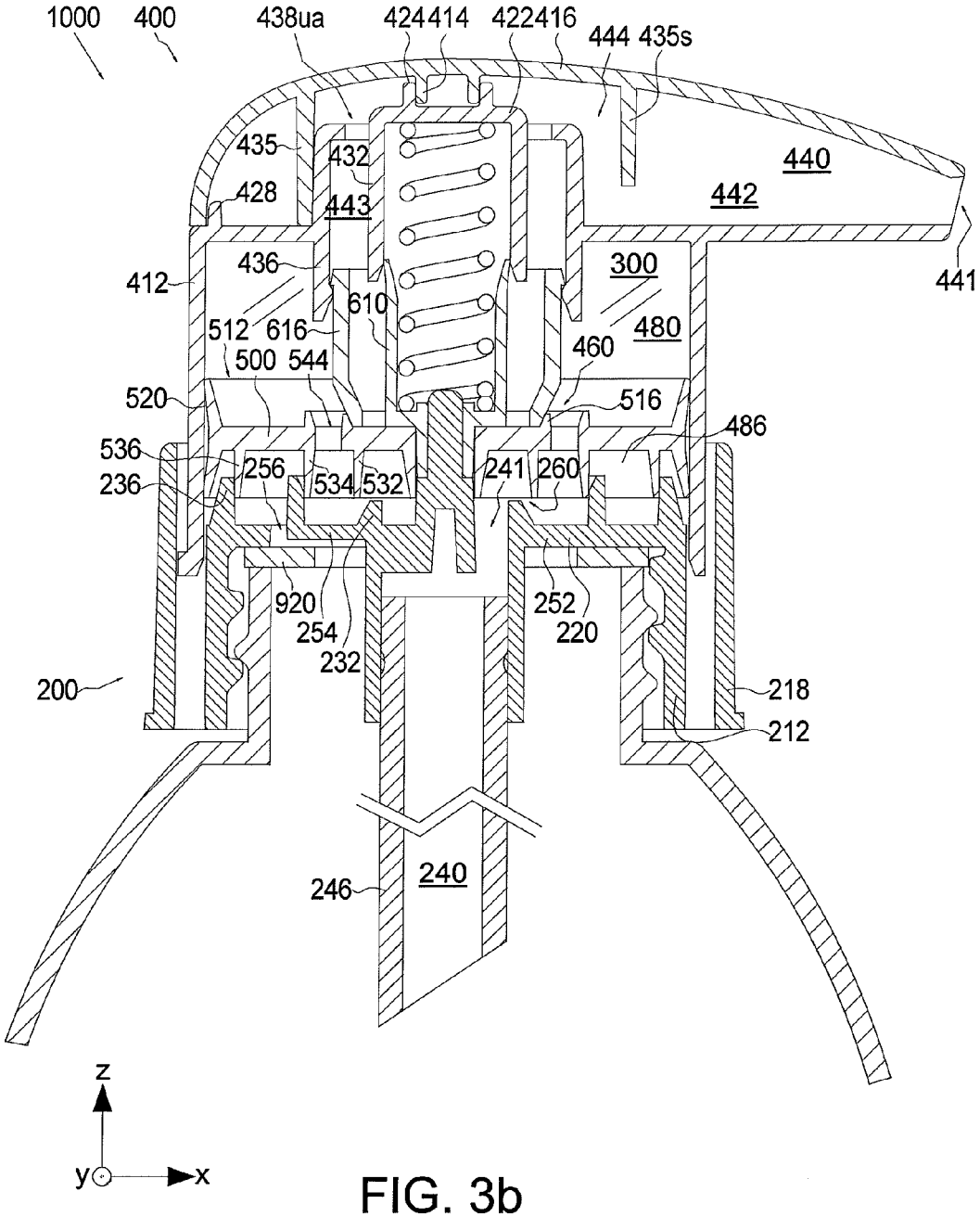
FIG. 3*b* shows a longitudinal cross-sectional view of a dispensing device according to the second embodiment of the present invention in the rest position.

With particular reference to FIGS. 3*a* and 3*b*, the actuator element 400 comprises an upper portion 452 and a lower portion 454, suited to be rigidly fixed to each other.

The upper portion 452 comprises a top wall 416, suited to be connected to a side annular wall 412 belonging to the lower portion 454. The upper portion 452 comprises also a wall 435 that develops in the vertical direction from the side of the top wall 416 facing towards the lower portion 454. The wall 435 is suited to cooperate with the second side wall 434 of the lower portion 454, in such a way as to define a portion of the dispenser duct 440, as described in greater detail below.

The lower portion 454 comprises a first annular wall 432 and a second annular wall 436 that is coaxial with the first annular wall 432 and whose diameter is larger than the diameter of the first annular wall 432, similarly to that which happens in the first embodiment of the invention. The first annular wall defines a substantially cylindrical cavity 434. The first annular wall 432 and the second annular wall 436 then define an annular cavity 438. The common axis of the cylindrical cavity 438 and of the annular cavity 438 is substantially vertical.

An annular separator element 426 develops in radial direction on a substantially horizontal plane between the second annular wall 436 and the outer annular wall 412. A cavity 480 is defined laterally by the outer annular wall 412 and at the top by the horizontal separator element 426.

The annular cavity 438 defined by the first annular wall 432 and by the second annular wall 436 communicates with the cavity 480 through an opening located near the lower end portion of the annular cavity 438. The annular cavity 438 communicates with the outside also through a second opening 438*ua* located near the upper end portion of the annular cavity 438.

A substantially circular wall 422 is formed near the end portion of the first annular wall 432 opposite the end facing towards the cavity 480, in such a way as to close the top of the cavity 434 defined by the first annular wall 432. The surface of the circular wall 422 opposite the surface facing towards the cavity 434 comprises a projecting annular element 424 suited to be coupled with a projecting annular element 414 formed on the surface of the top wall 416 facing towards the lower portion 454. The mutual engagement of the projecting annular elements with each other allows the upper portion 452 to be fixed to the lower portion 454 more easily. For example, the projecting annular elements 424 and 414 may be configured in such a way as to obtain a fixing mechanism.

Similarly, a protruding element 428 may be formed on the surface of the annular separator element 426 opposite the surface facing towards the cavity 480. The protruding element 428 is suited to be coupled with a portion of the inner surface of the top wall 416 in such a way as to make it easier to fix the upper portion 452 to the lower portion 454.

When the upper portion 452 is fixed to the lower portion 454, as shown in FIG. 3*b*, the dispenser duct 440 is defined. In particular, a sub-portion of the second portion 443 of the dispenser duct comprises the annular cavity 438 defined by the first annular wall 434 and by the second annular wall 436. The first portion 442 of the dispenser duct 440 is then defined by a portion of the top wall 416 and by an extension 427 of the annular separator element 426. The extension 427 develops along the same plane on which the separator element 426 lies. The intermediate portion 444 of the dispenser duct 440 is limited by the opening 438*ua* through which the second portion 443 communicates with the intermediate portion 444 and by a second vertical wall 435*s* formed on the surface of the top wall 416 facing towards the dispenser duct 440. It can be observed that, while the first vertical wall 435 develops from the top wall 416 to the separator element 426, the second vertical wall 435*s* is shorter than the first vertical wall 435, so that an opening is left between the second vertical wall 435*s* and the separator element 426, through which the first portion 442 of the dispenser duct 440 communicates with the intermediate portion 444.

The union element 600 is rigidly fixed to the connection element 200 by means of the pin 224, as previously described with reference to the first embodiment of the invention. Furthermore, the union element 600 is slidingly coupled with the first annular wall 432 and with the second annular wall 436 exactly like in the first embodiment of the invention.

When the union element 600 is slidingly connected to the actuator element 400, the annular cavity 638 defined by the cylindrical element 610 and by the outer annular wall 616 of the union element 600 communicates, through the opening 638*o*, with the annular cavity 438 of the actuator element 400 forming a single annular cavity. This annular cavity formed in this way constitutes the second portion 443 of the dispenser duct 440. The second portion 443 of the dispenser duct 440 communicates, near a first upper end, with the intermediate portion 444 of the dispenser duct 440 through the opening 438*ua*. The second portion 443 of the dispenser duct 440 communicates, near the second lower end, with the cavity 480 defined inside the actuator element 400 through the communication holes 618 of the union element 600. Therefore, the communication holes 618 coincide with the inlet opening 447 of the dispenser duct 440.

An elastic element 800 may be present inside the cavity defined by the cylindrical portion 610 of the union element 600 and by the first annular wall 432, as previously described with reference to the first embodiment of the invention.

Even according to the second embodiment of the invention, the suction/compression chamber is obtained inside the cavity 480 defined by the actuator element 400. According to the second embodiment of the invention, the suction/compression chamber 300 is limited at the top by the annular separator element 426. Furthermore, the suction/compression chamber 300 is limited laterally by the outer side wall 412 and at the bottom by the membrane 500 and by the separator element 220 of the connection element 200, similarly to that which happens in the first embodiment of the invention. Therefore, the suction/compression chamber 300 is completely outside the container C when the dispensing device 1000 is mounted on the container C.

Figure 3C:
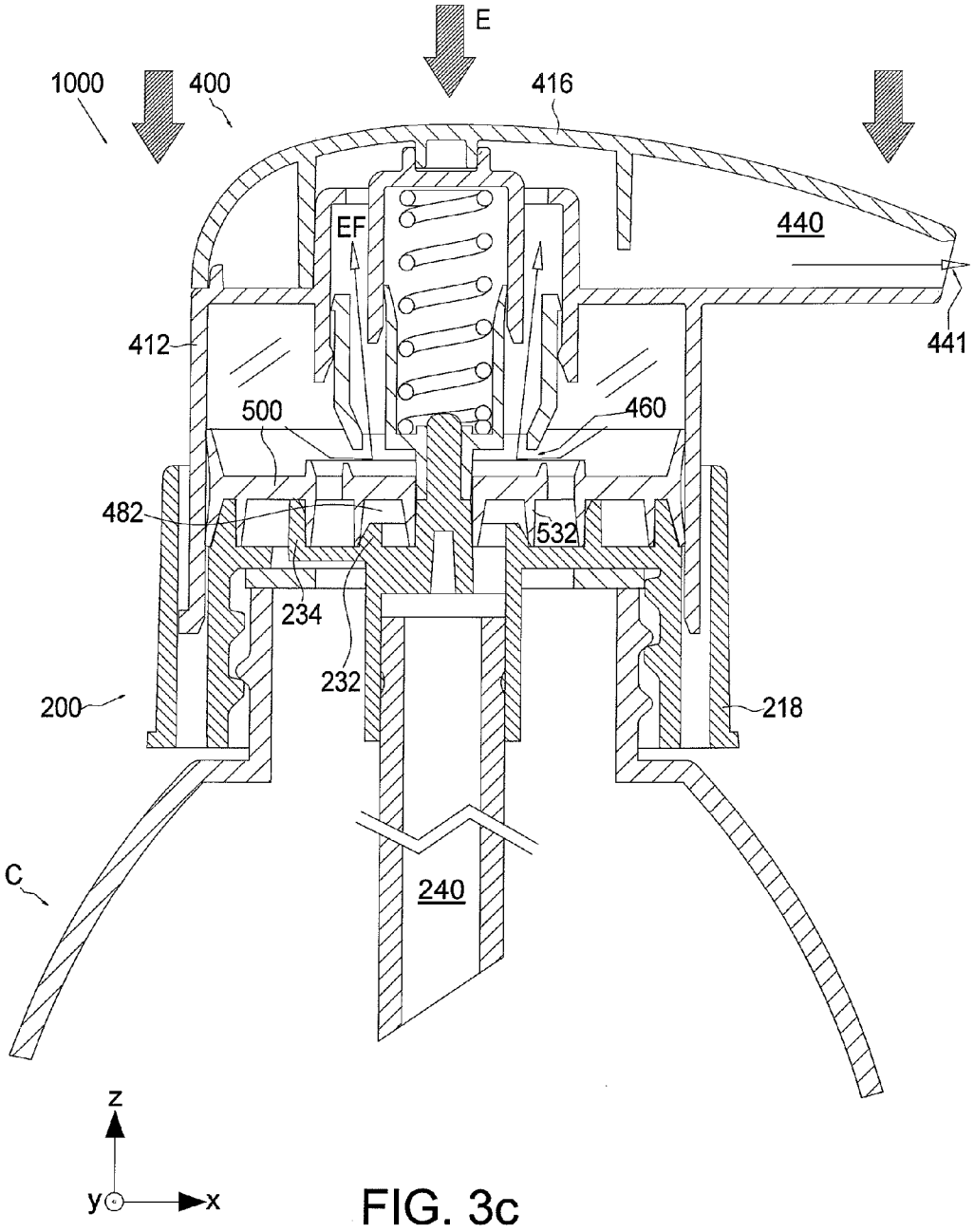
FIG. 3*c* shows a longitudinal cross-sectional view of a dispensing device according to the second embodiment of the present invention during the dispensing step.
Figure 3D:
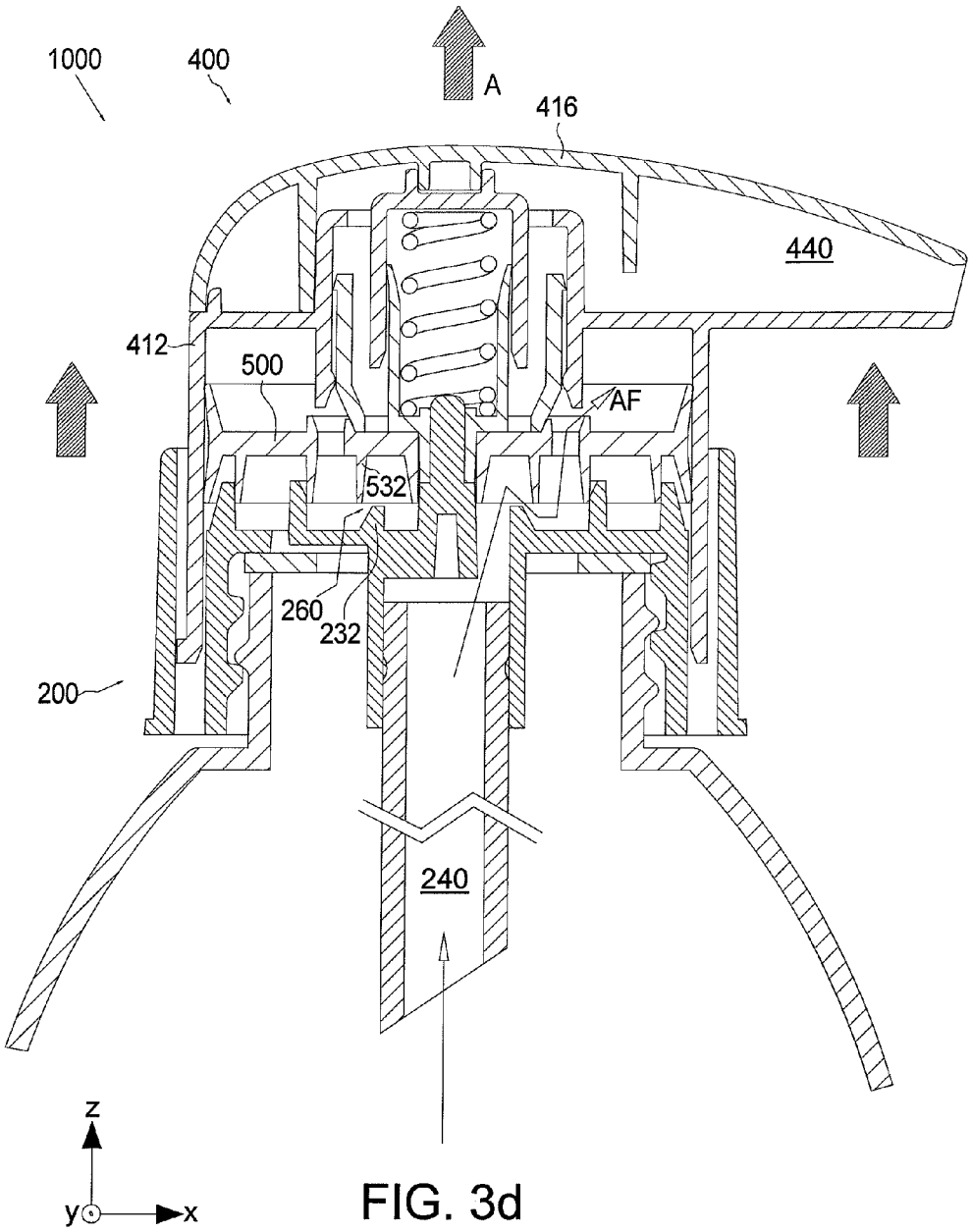
FIG. 3*d* shows a longitudinal cross-sectional view of a dispensing device according to the second embodiment of the present invention during the suction step.

The operation of the pump 1000 according to the second embodiment during the suction and dispensing steps is respectively illustrated in FIGS. 3*c* and 3*d* and is completely equivalent to the operation of the pump 1000 according to the first embodiment of the invention in the corresponding steps. Therefore, for details on the operation of the pump 1000 according to the second embodiment of the invention reference should be made to the description provided with reference to FIGS. 2*c* and 2*d*.

Figure 3E:
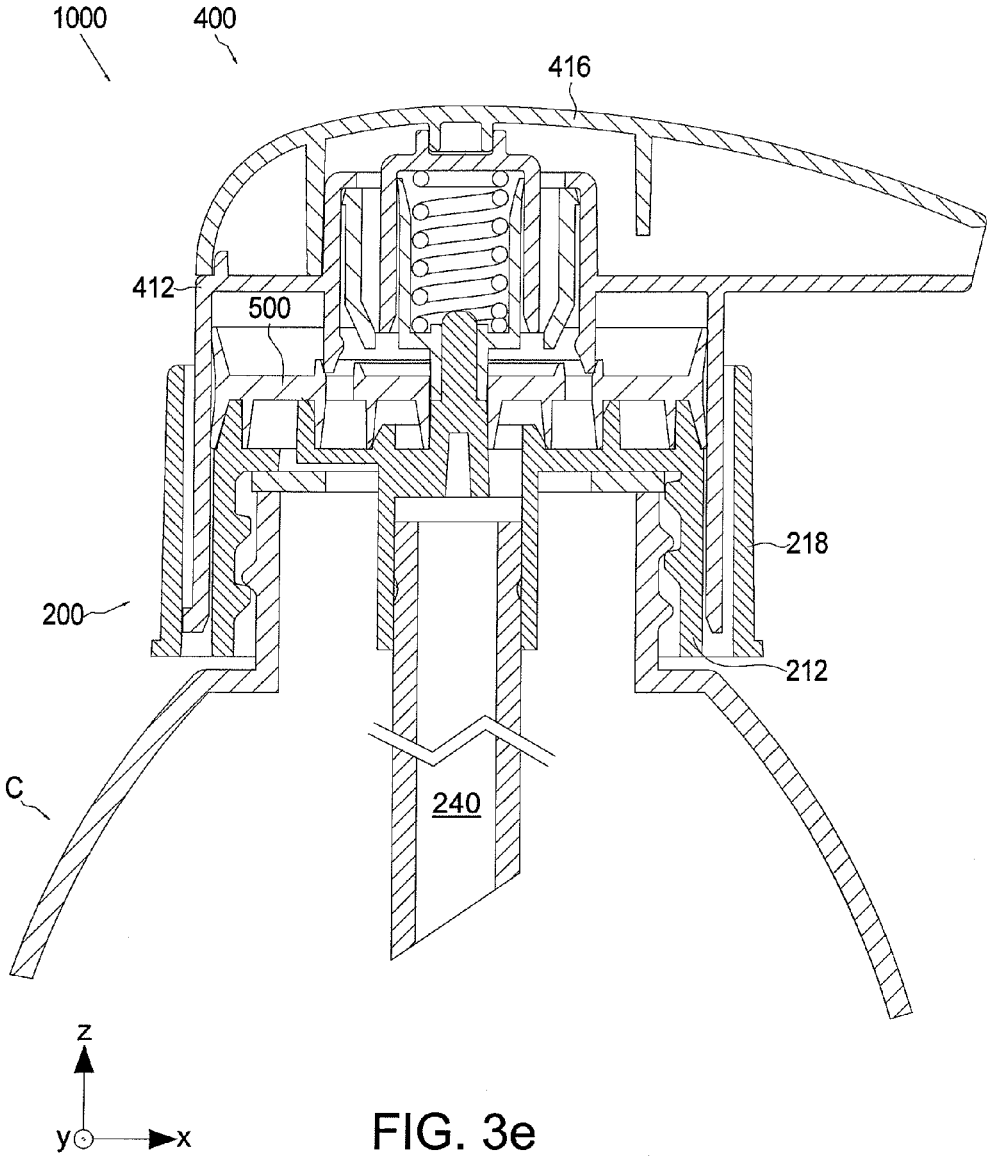
FIG. 3*e* shows a longitudinal cross-sectional view of a dispensing device according to the second embodiment of the present invention in the locked position.

FIG. 3*e* shows the pump 1000 in the locked position, in which suitable locking means maintain the actuator element 400 locked in the position in which it is at the minimum distance from the connection element 200.

Figure 3F:
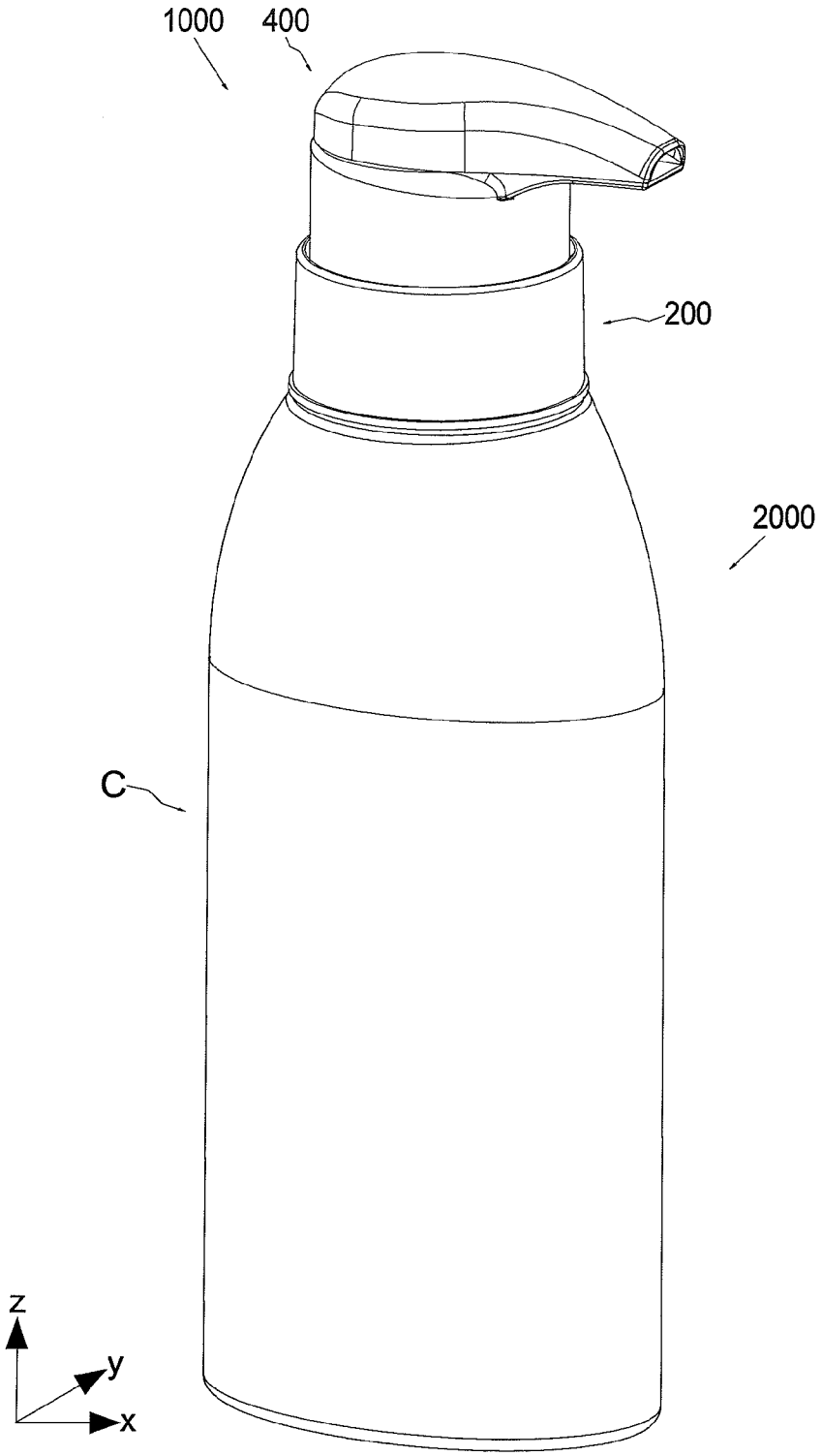
FIG. 3*f* shows a perspective side view of a system for containing and dispensing fluids comprising a container to which a dispensing device according to the second embodiment of the present invention is applied.

FIG. 3*f* shows a system 2000 suited to contain and dispense fluids, comprising the dispensing device 1000 according to the second embodiment of the invention applied to a container C.

In addition to the advantages described with reference to the previous embodiment, the pump 1000 according to the second embodiment ensures more flexibility in terms of design and appearance. In fact, since the actuator element is constituted by two distinct portions, it is relatively easy to modify its appearance in such a way as to meet the most varied practical and aesthetic needs. For example, it is possible to have a series of upper portions, each with a different aspect, so that they can be alternatively fixed to the same lower portion. If the upper portion is fixed to the lower portion by means of a quick mechanism like, for example, a fixing mechanism, it is thus easy to modify the appearance of the pump by replacing an upper portion with another one that is more suitable for one's needs.

Figures from 4*a* to 4*f* schematically show a third embodiment of the pump 1000 according to the present invention.

The pump 1000 according to the third embodiment of the invention differs from the first embodiment essentially for the arrangement of the suction/compression chamber. Only the differences between the third and the first embodiment of the invention are described here below. It is understood that, if not expressly specified otherwise, the description of analogous or identical component parts provided with reference to the first embodiment of the invention applies also to the third embodiment of the invention.

The actuator element 400, the elastic element 800, the union element 60 and the membrane 500 of the pump 1000 according to the third embodiment of the invention have a structure that is similar or identical to the structure of the corresponding parts of the pump according to the first embodiment of the invention.

The connection element 200 of the pump 1000 comprises a separator element 220, substantially identical to the separator element 220 according to the first embodiment described above. The connection element comprises also a side wall 210 that delimits the connection element 200 laterally. Differently from the first embodiment of the invention, the side wall 210 comprises a first annular sub-wall 212, a second annular sub-wall 218 and a third annular sub-wall 211, all substantially cylindrical, coaxial and having their common longitudinal axis substantially parallel to the vertical axis z.

The diameter of the second sub-wall 218 is larger than the diameter of the first sub-wall 212. The diameter of the third sub-wall 211 is larger than the diameter of the second sub-wall 218.

The first sub-wall 212 and the second sub-wall 218 have analogous shape and function, respectively, to those of the inner sub-wall 212 and of the outer sub-wall 218 according to the first embodiment of the invention. In particular, the first sub-wall 212 and the second sub-wall 218 define an annular cavity 214 that at its top communicates with the outside through an annular opening 214*a*. The annular cavity 214 is closed at the bottom by a first connection portion 216 of the wall 210 that connects the first wall 212 and the second wall 218. The first connection portion 216 develops on a substantially horizontal plane in such a way as to connect a portion of a first lower end of the first sub-wall 212 to a portion of a first lower end of the second sub-wall 218. In this way, the side wall 210 substantially follows a U-shaped profile at the level of the connection portion 216 and of the first end portions of the first sub-wall 212 and of the second sub-wall 218.

According to the third embodiment of the invention, the second sub-wall 218 is substantially longer than the first sub-wall 218.

Differently from the first embodiment of the invention, the side wall 210 of the connection element comprises a third sub-wall 211, comprising a first end and a second end positioned above the first end.

The second sub-wall 218 and the third sub-wall 211 define an annular cavity 215. The surface of the second sub-wall 218 facing towards the cavity 215 is opposite the surface of the second sub-wall 218 facing towards the cavity 214.

The cavity 215 communicates with the outside through an annular cavity 215*a* formed near a portion of a first end of the cavity 215. The opening 215*a* is defined by a portion of the second sub-wall 218 and by a portion of the first end of the third sub-wall 211.

Figure 4A:
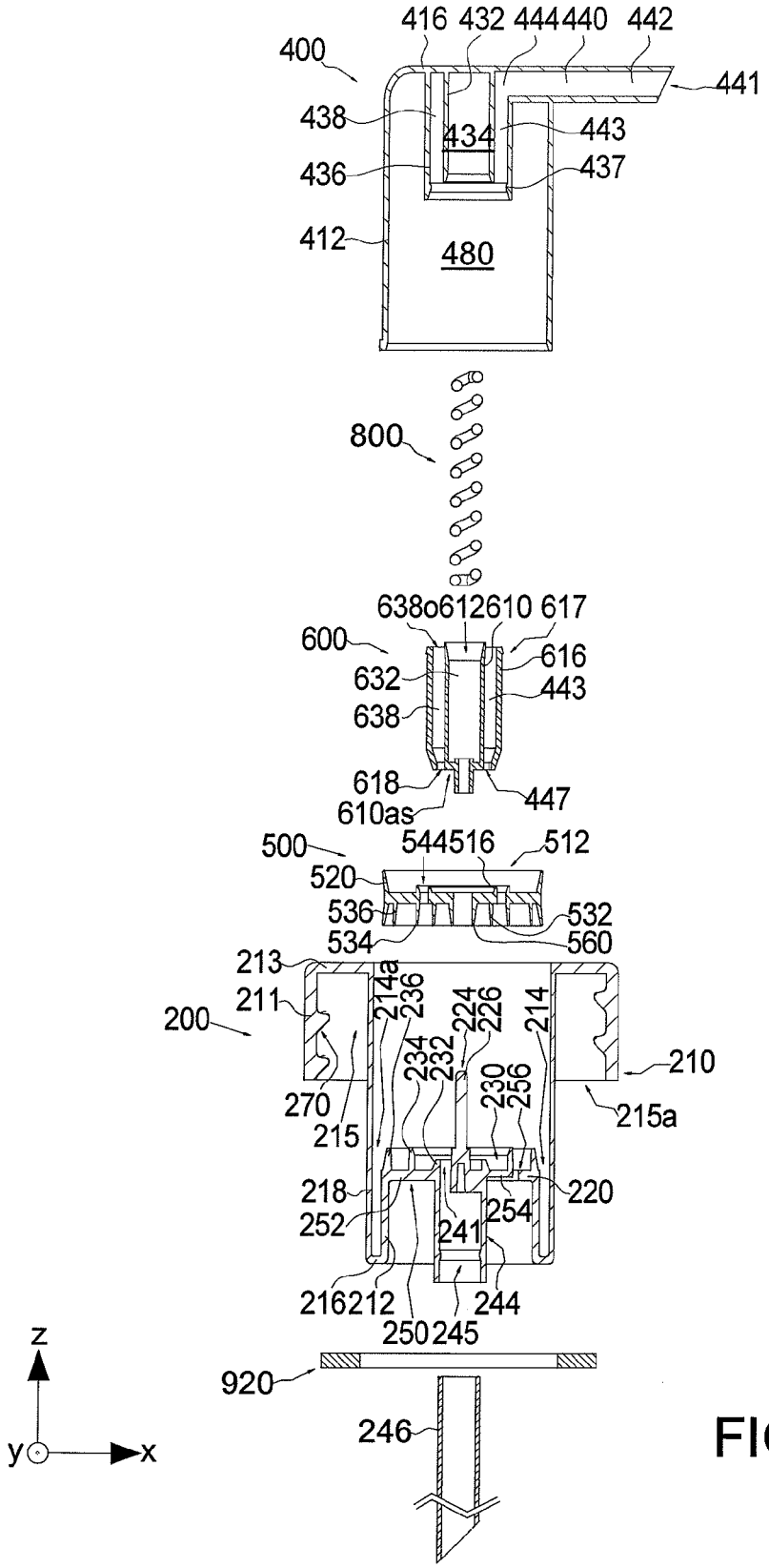
FIG. 4*a* shows a longitudinal exploded cross-sectional view of a dispensing device according to a third embodiment of the present invention.
Figure 4B:
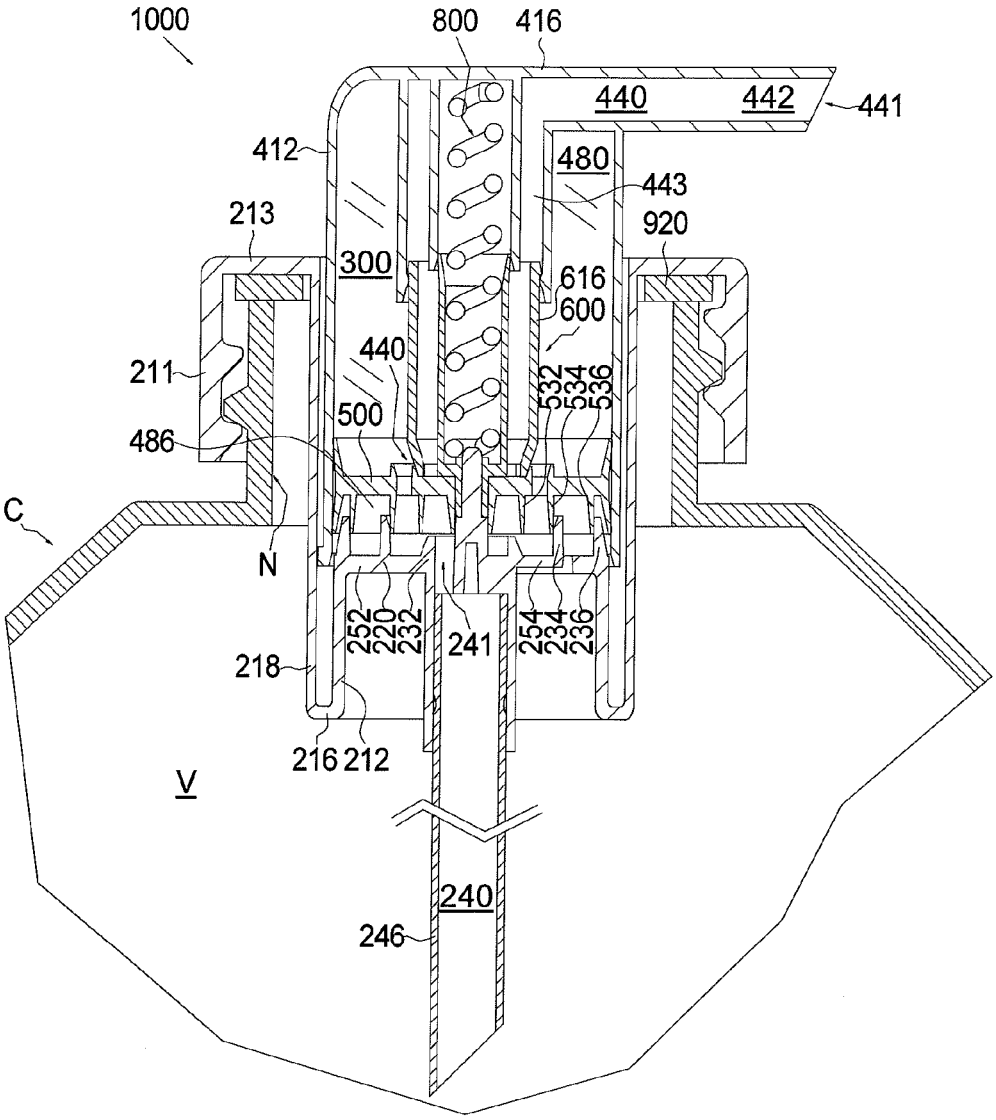
FIG. 4*b* shows a longitudinal cross-sectional view of a dispensing device according to the third embodiment of the present invention in the rest position.
Figure 4B:
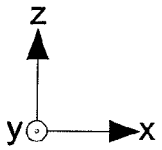

The cavity 215 is then delimited at its top by a second connection portion 213 located near a portion of a second end of the cavity 215 opposite the first end. In FIGS. 4*a* and 4*b* the second end of the cavity 215 is located above the first end. The second connection portion 213 develops radially and on a substantially horizontal plane from a portion of the second end of the second sub-wall 218 to a portion of the second end of the third sub-wall 211. The second end of the second sub-wall 218 is opposite and above the first end, the first connection portion 216 being connected to a portion of said first end. In other words, the second sub-wall 218 develops along the vertical direction from the first connection sub-portion 216 to the second connection sub-portion 213.

The profile of the side wall 210 follows a second "U" shape at the level of the second connection portion and of the portions of the second ends of the second sub-wall 218 and of the third sub-wall 211, with the second connection portion 213 developing in-between. It can be noted that this second U has its concave part facing the direction opposite the first U formed by the first connection portion 216 and by the end portions of the first sub-wall 212 and of the second sub-wall 218 to which the first connection portion 216 is connected. In the specific case of Figures from 4*a* to 4*e*, the first U has its concave part facing upwards, while the second U has its concave part facing downwards.

The length of the second sub-wall 218 and the length of the first sub-wall 212 are such that the second connection portion 213 lies along a horizontal plane positioned above the plane on which the separator element 220 of the connection element 200 lies. In particular, in the embodiment illustrated in Figures from 4*a* to 4*e*, the second connection element 213 is located above each point of the connection element 220.

According to the third embodiment of the invention, the connection means 270, whose structure is analogous to the structure of the connection means according to the first embodiment of the invention, are formed on the inner surface of the third sub-wall 211, meaning on the surface of the third sub-wall 211 facing towards the cavity 215.

As shown in FIG. 4*b*, when the pump 1000 is mounted on the container C, the neck N of the container C is housed in the cavity 215, in such a way that the connection means 270 of the third sub-wall 213 cooperate with the coupling means T of the neck N of the container C. Furthermore, when the pump 1000 is applied to the container C, the second connection portion 213 is in contact with the gasket 920, when this is present, or with the upper portion of the neck N of the container that defines the opening I. In this way, the annular connection portion 213 of the side wall 210 is suited to perform the same function performed, in the first embodiment of the invention, by the portion of the lower side 250 of the separator element 220 included in the thicker sub-portion 252. Again with reference to FIG. 4*b*, the first sub-wall 212 and the second sub-wall 218 are inside the container C when the device 1000 is mounted on the container C. Therefore, the diameter of the second sub-wall 218 is preferably smaller than the diameter of the neck N of the container C to which the pump 1000 must be applied. In this way, the portion of the pump delimited laterally by the second sub-wall 218 can be introduced in the neck N of the container C through the opening I. Preferably, at least one portion of the upper side 230 of the separator element 220 of the connection element 220 lies along a horizontal plane positioned below the opening I through which the volume V enclosed by the container C communicates with the outside.

According to the third embodiment of the invention, the suction/compression chamber 300 is structured exactly as in the first embodiment of the invention. In particular, the suction/compression chamber 300 according to the third embodiment of the invention is limited at the top and at the sides by the actuator element 400 and at the bottom by the membrane 500 and by the upper side 230 of the separator element 220. Since at least one portion of the upper side 230 of the separator element 220 is situated inside the container C, at least one portion of the suction/compression chamber occupies the volume V enclosed by the container C.

In the embodiment of the invention shown in FIG. 4*b*, the suction/compression chamber 300 is partially contained in the container C and partially located outside it. In general, the volume of the portion of the suction/compression chamber located outside the container C varies as the position of the actuator element 400 with respect to the connection element 200 and the container C varies.

The membrane 500 according to the third embodiment of the invention can be translated between a top dead centre and a bottom dead centre, exactly as explained with reference to the first embodiment of the invention. In the embodiment shown in FIG. 4*b*, the membrane 500 is constantly inside the container C when the pump 1000 is mounted on the container C. In other specific embodiments of the invention not illustrated in the figures, the membrane 500 is suited to occupy positions that are both outside and inside the container C during its translational motion between the top dead centre and the bottom dead centre. It should be noted that it is possible to include an actuator element 400 comprising two distinct portions even in combination with the third embodiment just described above, although this embodiment is not illustrated in the figures.

Figure 4C:
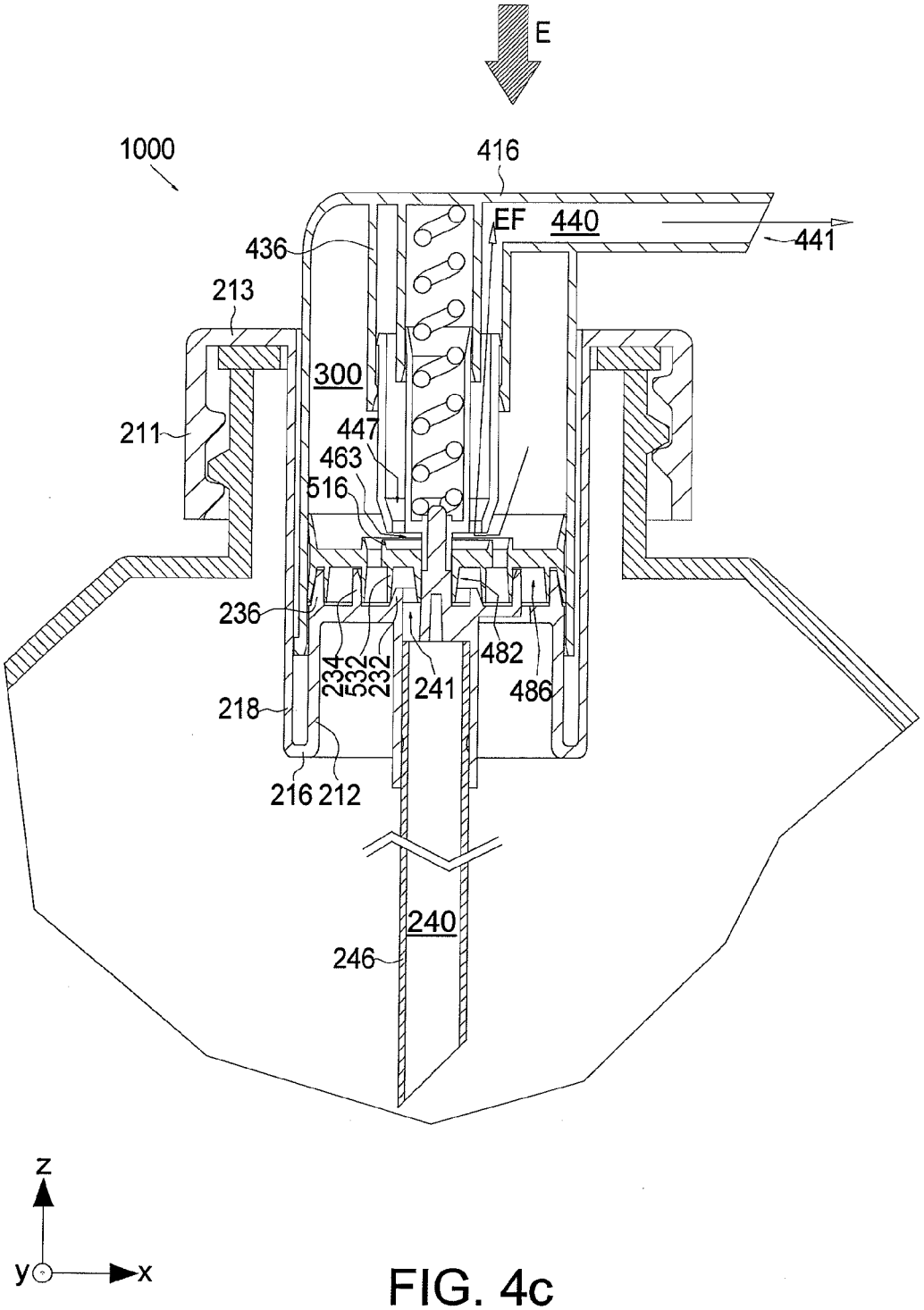
FIG. 4*c* shows a longitudinal cross-sectional view of a dispensing device according to the third embodiment of the present invention during the dispensing step.
Figure 4D:
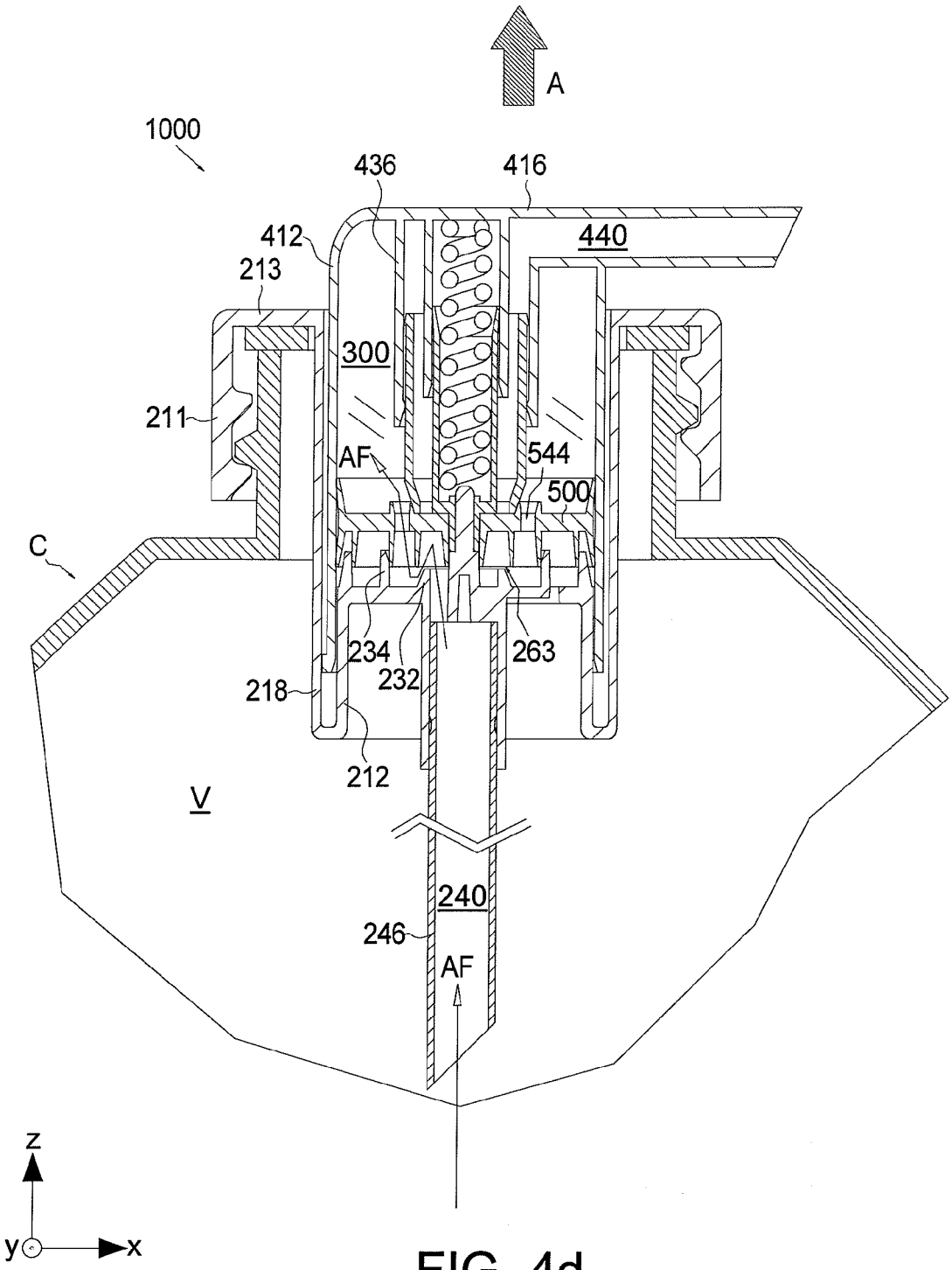
FIG. 4*d* shows a longitudinal cross-sectional view of a dispensing device according to the third embodiment of the present invention during the suction step.

The operation of the pump 1000 according to the third embodiment during the suction and dispensing steps is respectively illustrated in FIGS. 4*c* and 4*d* and is completely equivalent to the operation of the pump 1000 according to the first embodiment of the invention in the corresponding steps. Therefore, for details on the operation of the pump 1000 according to the second embodiment of the invention reference should be made to the description provided with reference to FIGS. 2*c* and 2*d*.

Figure 4E:
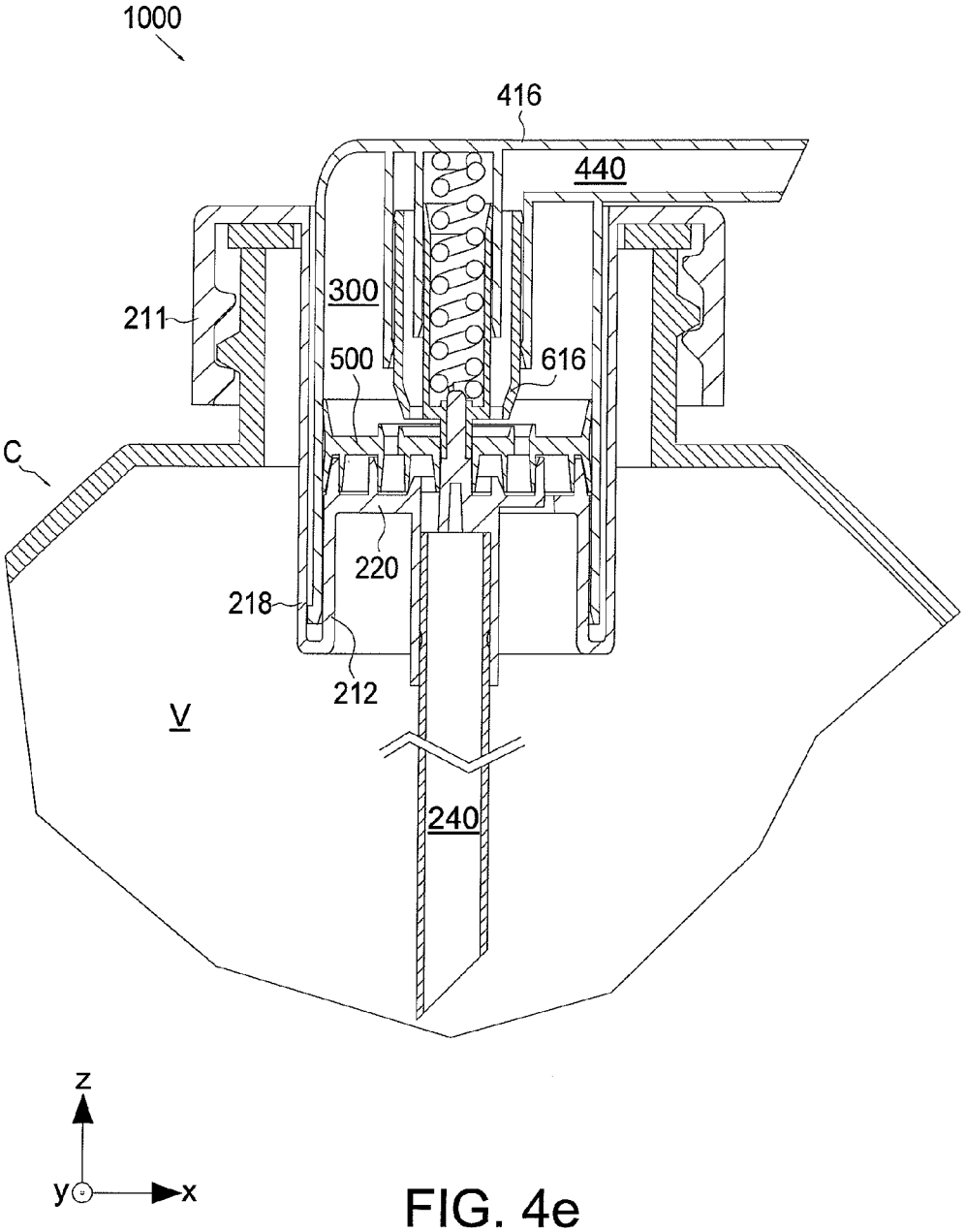
FIG. 4*e* shows a longitudinal cross-sectional view of a dispensing device according to the third embodiment of the present invention in the locked position.

FIG. 4*e* shows the pump 1000 in the locked position, in which suitable locking means maintain the actuator element 400 locked in the position in which it is at the minimum distance from the separator element 220 of the connection element 200.

Figure 4F:
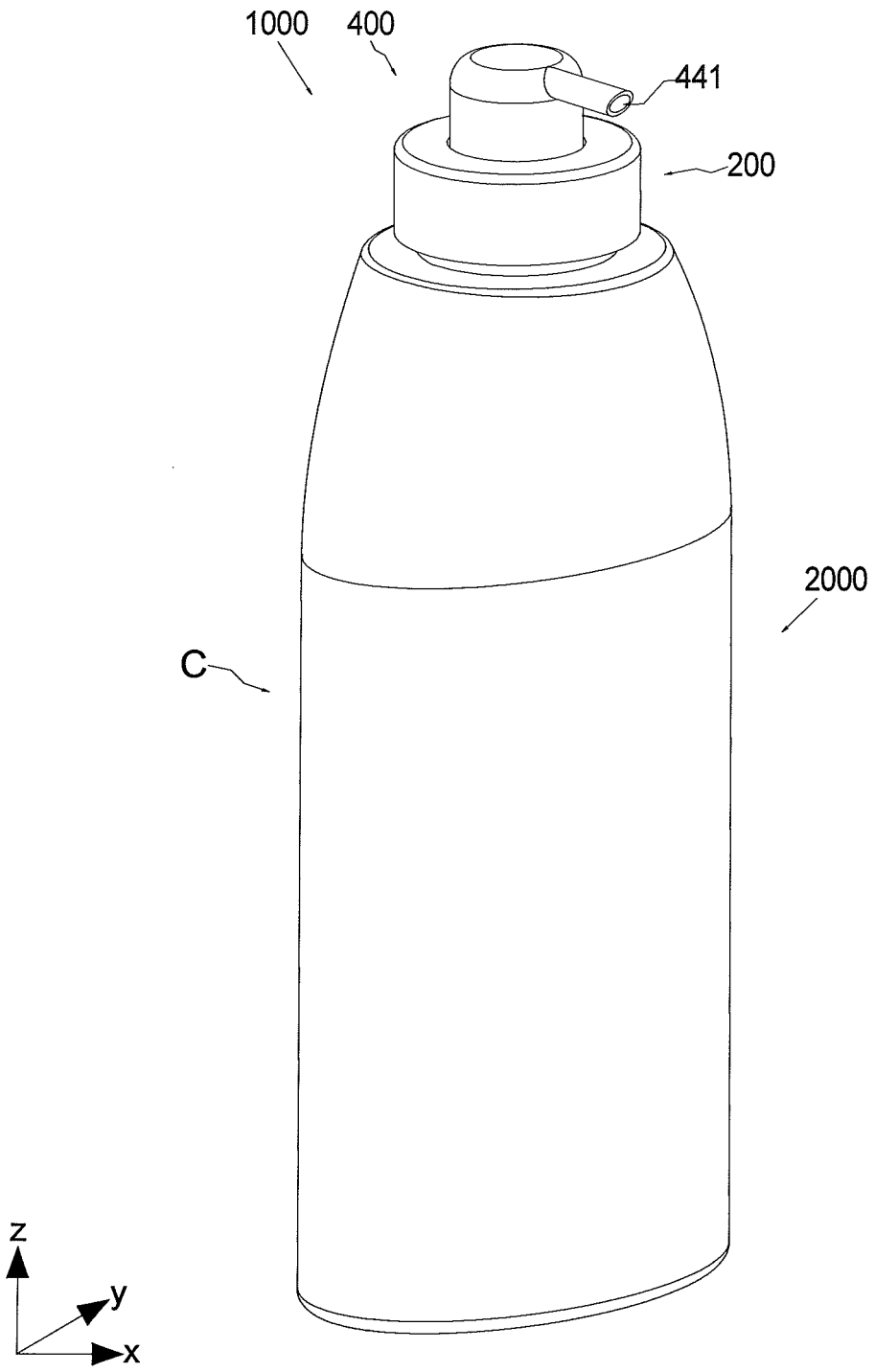
FIG. 4*f* shows a perspective side view of a system for containing and dispensing fluids comprising a container to which a dispensing device according to the third embodiment of the present invention is applied.

FIG. 4*f* shows a system 2000 suited to contain and dispense fluids, comprising the dispensing device 1000 according to the third embodiment of the invention applied to a container C.

The third embodiment of the invention offers the same advantages illustrated above with reference to the preceding embodiments and deriving from the fact that it has a single shared movable element for the suction valve and the dispensing valve and from the arrangement of the suction/compression chamber inside a cavity defined by the actuator element.

Furthermore, according to the third embodiment of the invention, the suction/compression chamber is partially contained inside the container to which the dispensing device is applied. This makes it possible to reduce the volume of the portion of the suction/compression chamber situated outside the container, thus reducing the overall dimensions and the size of the component parts located outside the container.

The pump 1000 according to the present invention can be made with different materials. Preferably, most of the elements that make up the pump 1000 can be made with one or more plastic materials. The elastic element may also comprise a metallic material. Preferably, the plastic material with which the membrane is made is different from the plastic material or the plastic materials with which the actuator element and the connection element are made. In particular, the material with which the membrane 500 is made is selected so that the membrane achieves optimal tightness together with the walls of the suction/compression chamber and with the cylindrical surface with which the inner annular wall of the membrane cooperates, if necessary.

Although the present invention has been described with reference to the embodiments described above, for the expert in the art it is clear that it is possible to make modifications, variants and improvements of the present invention based on the explanations provided above and within the scope of the attached claims without departing from the subject and scope of the invention. In addition to that, the aspects that are assumed to be known to the experts in the art have not been described in order to avoid uselessly putting the invention described herein in the shade. Consequently, the invention is not limited to the embodiments described above but is limited exclusively by the scope of the following claims.

The invention claimed is:

1. A dispensing device for dispensing a fluid, suited to be connected, by means of a connection element (220), to a container (C) inside which said fluid is held, said fluid being suited to be dispensed from the inside to the outside of said container through an actuator element (400), said dispensing device comprising:

a suction duct (240) suited to communicate with said fluid held inside said container (C);

a dispenser duct (440) in communication with the outside with respect to the volume (V) enclosed by said container (C);

a suction/compression chamber (300) that can communicate with said suction duct (240) and said dispenser duct (440);

a suction valve (260) suited to alternately allow and prevent the passage of a fluid between said suction duct (240) and said suction/compression chamber (300) when said suction valve is respectively closed and open;

a dispensing valve (460) suited to alternately allow and prevent the passage of a fluid between said dispenser duct (440) and said suction/compression chamber (300) when said suction valve is respectively closed and open;

a tight membrane (500) slidingly coupled with the walls of said suction/compression chamber (300) so that it can be translated in a predetermined direction;

both said suction valve (260) and said dispensing valve (460) comprising said membrane (500).

2. The dispensing device according to claim 1, wherein said membrane (500) is suited to be translated in said suction/compression chamber (300) between said suction duct (240) and said dispenser duct (440).

3. The dispensing device according to claim 1, wherein said membrane (500) is suited to be translated within an interval delimited by a first position and a second position, said suction valve (260) being closed when said membrane (500) is in said first position and said dispensing valve (460) being closed when said membrane (500) is in said second position.

4. The dispensing device according to claim 1, wherein said membrane is suited to be translated so that when said suction valve (260) is closed said dispensing valve (460) is open and vice versa.

5. The dispensing device according to claim 1, wherein said membrane (500) comprises an upper side (512) facing towards said dispenser duct (440), said dispensing valve (460) comprising at least one portion of said upper side (512) of said membrane.

6. The dispensing device according to claim 5, wherein said upper side (512) of said membrane (500) comprises upper sealing means suited to cooperate with said dispenser duct (440) in such a way as to form a tight area, said suction valve being closed when said upper sealing means cooperate with said dispenser duct (440).

7. The dispensing device according to claim 6, wherein said upper sealing means comprise an annular projection (516) on said upper side (512) of said membrane (500) suited to cooperate with said dispenser duct (440) in such a way as to form a tight area that is suited to close a communication opening between said dispenser duct (440) and said suction/compression chamber (300).

8. The dispensing device according to claim 1, wherein said membrane (500) comprises a lower side (514) facing towards said suction duct (240), said suction valve (260) comprising at least one portion of said lower side (514) of said membrane (500).

9. The dispensing device according to claim 8, wherein said lower side (514) of said membrane (500) comprises lower sealing means suited to cooperate with said suction duct (240) in such a way as to form a tight area, said suction valve (260) being closed when said lower sealing means cooperate with said dispenser duct (440).

10. The dispensing device according to claim 9, wherein said lower sealing means comprise a projecting annular element (532) suited to cooperate with a projecting annular element (232) formed on the surface of said connection element (200) facing towards said membrane (200), thus forming a tight area and in such a way as to prevent communication between said suction/compression chamber (300) and said suction duct (240).

11. The dispensing device according to claim 1, wherein said actuator element (400) comprises a first portion (452) and a second portion (454) suited to be rigidly fixed to each other.

12. The dispensing device according to claim 1, wherein said suction/compression chamber (300) is defined by said connection element (200) and said actuator element (400) in such a way that said suction/compression chamber (300) is at least partially outside said container (C) when said dispensing device is fixed to said container (C).

13. The dispensing device according to claim 12, wherein said suction/compression chamber (300) is completely outside said container (C) when said dispensing device is fixed to said container (C).

14. The dispensing device according to claim 1, wherein said suction/compression chamber (300) is defined by said connection element (200) and said actuator element (400) in such a way that said suction/compression chamber (300) is at least partially inside said container (C) when said dispensing device is fixed to said container (C).

15. System for containing and dispensing fluids (F), comprising:

a container (C) comprising a neck (N);

the dispensing device according to claim 1, said dispensing device being fixed to said neck (N) of said container (C) through said connection element (200).

* * * * *